US010626602B2

(12) United States Patent
Holbrook

(10) Patent No.: US 10,626,602 B2
(45) Date of Patent: Apr. 21, 2020

(54) WORKSTATION

(71) Applicant: HERMAN MILLER, INC., Zeeland, MI (US)

(72) Inventor: Richard Holbrook, Pasadena, CA (US)

(73) Assignee: HERMAN MILLER, INC., Zeeland, MI (US)

( * ) Notice: Subject to any disclaimer, the term of this patent is extended or adjusted under 35 U.S.C. 154(b) by 0 days.

(21) Appl. No.: 16/006,118

(22) Filed: Jun. 12, 2018

(65) Prior Publication Data

US 2018/0355608 A1 Dec. 13, 2018

Related U.S. Application Data

(60) Provisional application No. 62/518,079, filed on Jun. 12, 2017.

(51) Int. Cl.

| | |
|---|---|
| ***E04H 1/00*** | (2006.01) |
| ***E04B 2/74*** | (2006.01) |
| ***E04B 2/78*** | (2006.01) |

(52) U.S. Cl.

CPC ..... *E04B 2/7433* (2013.01); *E04B 2/78* (2013.01); *E04B 2/7444* (2013.01); *E04B 2/7836* (2013.01); *E04B 2002/7461* (2013.01); *E04B 2002/7462* (2013.01); *E04B 2002/7483* (2013.01)

(58) Field of Classification Search

CPC .. E04B 2/7433; E04B 2/78; E04B 2002/7483; E04B 2002/7461

USPC ..... 52/239

See application file for complete search history.

(56) References Cited

U.S. PATENT DOCUMENTS

| | | | | |
|---|---|---|---|---|
| 2,060,817 | A * | 11/1936 | Mahoney | G03B 21/606 160/352 |
| 2,266,854 | A | 12/1941 | Davis | |
| 2,775,794 | A | 1/1957 | Keely | |
| 3,585,768 | A * | 6/1971 | Klein | E04B 1/6175 52/238.1 |
| 4,968,171 | A * | 11/1990 | Shell | E04B 2/7427 16/224 |

(Continued)

FOREIGN PATENT DOCUMENTS

EP 0551186 A1 7/1993

OTHER PUBLICATIONS orangebox.com, Internet printout: http://www.orangebox.com/product_range/pods_and_screens, webpage accessed Apr. 7, 2016.

(Continued)

*Primary Examiner* — Basil S Katcheves

(74) *Attorney, Agent, or Firm* — Michael Best & Friedrich LLP

(57) ABSTRACT

A workstation includes a frame having a lower rail and a plurality of upright posts coupled to and extending upwardly from the lower rail. Each upright post has a track. The workstation also includes a plurality of panels supported by the frame. Each panel has a first side edge received in the track of one of the plurality of upright posts, a second side edge received in the track of another of the plurality of upright posts, and a lower edge adjacent the lower rail. The lower edge has a first length. Each panel also has an upper edge opposite the lower edge. The upper edge has a second length that is longer than the first length.

13 Claims, 22 Drawing Sheets

(56) References Cited

U.S. PATENT DOCUMENTS 5,038,539 A * 8/1991 Kelley ..... A47B 21/06 211/190
5,056,577 A * 10/1991 DeLong ..... E04B 2/7437 160/135
5,058,331 A 10/1991 Epps
5,070,642 A 12/1991 Albrecht
5,092,385 A 3/1992 Beaulieu
5,105,594 A 4/1992 Kirchner
D332,188 S 1/1993 Brodbeck
5,253,595 A 10/1993 Heidmann
5,287,909 A 2/1994 King et al.
5,406,760 A 4/1995 Edwards
5,502,930 A * 4/1996 Burkette ..... E04B 2/7429 16/225
5,592,794 A 1/1997 Tundaun
D396,572 S * 8/1998 Gongora ..... D6/643
5,803,146 A 9/1998 Boon
5,826,639 A 10/1998 Miller
5,875,597 A 3/1999 Gingrich et al.
5,899,035 A * 5/1999 Waalkes ..... E04B 2/7433 52/239
6,098,358 A 8/2000 Waalkes
6,122,865 A * 9/2000 Branc ..... G09F 15/0068 52/239
6,240,687 B1 6/2001 Chong
6,272,795 B1 8/2001 Brauning
D459,109 S * 6/2002 Couture ..... D6/648.3
6,481,678 B1 11/2002 Chong
D481,886 S 11/2003 Fahnstrom et al.
D538,060 S * 3/2007 Golino ..... D6/643
D603,185 S 11/2009 Bockheim
D641,560 S * 7/2011 Thompson ..... D6/332
D651,416 S 1/2012 Martin
8,371,460 B2 2/2013 Ghatikar et al.
8,973,642 B2 * 3/2015 Lawson ..... E04H 1/1272 160/135
D727,042 S * 4/2015 Wagner ..... D6/338
D728,947 S 5/2015 Schweikarth
D743,189 S 11/2015 Hecht
9,315,986 B2 4/2016 Oliveira et al.
D758,776 S 6/2016 McKenna et al.
9,403,400 B2 * 8/2016 McManus ..... A47B 97/04
D778,075 S 2/2017 Holbrook
D778,626 S 2/2017 Holbrook
D785,374 S * 5/2017 Holbrook ..... D6/643
2002/0179558 A1 12/2002 Venegas
2003/0047292 A1 * 3/2003 Fritsche ..... E04B 2/7433 160/135
2003/0205010 A1 11/2003 Anglin
2004/0140066 A1 7/2004 Brennan
2005/0140184 A1 6/2005 Williams et al.
2007/0175131 A1 8/2007 Mueller
2007/0261315 A1 * 11/2007 Ludwig ..... E04B 2/7416 52/28
2007/0261613 A1 11/2007 Watson et al.
2008/0016804 A1 * 1/2008 Ludwig ..... A47C 11/00 52/249
2008/0134601 A1 6/2008 Cruz
2012/0311937 A1 * 12/2012 Parshad ..... E04B 2/7422 52/36.1
2014/0075757 A1 * 3/2014 Hager ..... E05B 65/006 29/897.32
2015/0300010 A1 * 10/2015 Loffler ..... E04B 2/7437 52/36.5
2016/0128469 A1 * 5/2016 Matthai ..... E04B 2/7416 312/265.1
2016/0213146 A1 * 7/2016 Gosling ..... A47B 9/12
2016/0262537 A1 * 9/2016 Gaschy ..... A47B 83/001
2016/0348358 A1 * 12/2016 Udagawa ..... E04B 2/7405
2017/0138045 A1 * 5/2017 Lasry ..... E04B 2/7448
2017/0211273 A1 * 7/2017 Wyllie ..... E04B 2/7416

OTHER PUBLICATIONS buzzi.space, Internet printout: http://buzzi.space/buzziville/, webpage accessed Apr. 7, 2016.
bene.com, Internet printout: http://bene.com/en/docklands-pearsonlloyd/, webpage accessed Apr. 7, 2016.
frameryacoustics.com, Internet printout: http://www.frameryacoustics.com/en/home/, webpage accessed Apr. 7, 2016.
hermanmiller.com, Internet printout: http://www.hermanmiller.com/global/en_apc/products/workspaces/collaborative-furniture/kivo.html, webpage accessed Apr. 7, 2016.
nomadflexiblefurniture.com, Internet printout: http://www.nomadflexiblefurniture.com/hive_web/collaboration.html, webpage accessed Apr. 7, 2016.
vitra.com, Apr. 7, 2016, Internet printout: https://www.vitra.com/en-us/product/workbays?subfam.id=207226, webpage accessed Apr. 7, 2016.
haworth.com, Internet printout: http://www.haworth.com/home/workspaces/collaborative/openest, webpage accessed Apr. 7, 2016.

* cited by examiner

WORKSTATION

CROSS REFERENCE TO RELATED APPLICATIONS

This application claims priority to U.S. Provisional Patent Application No. 62/518,079, filed on Jun. 12, 2017, the contents of which are incorporated by reference herein.

BACKGROUND

The present invention relates to a furniture system, such as a workstation.

Typically, workstations are used by individuals or groups of people to work on tasks and/or discuss projects. Workstations help separate individuals from the surrounding area by providing at least some privacy and focus. For example, a student may use a workstation to work alone or with a group of people on tasks (e.g., homework assignments, school projects, etc.). Additionally, office workers may use a workstation to host meetings, discuss projects, and the like.

SUMMARY

In one embodiment, the invention provides a workstation including a frame having a lower rail and a plurality of upright posts coupled to and extending upwardly from the lower rail. Each upright post has a track. The workstation also includes a plurality of panels supported by the frame. Each panel has a first side edge received in the track of one of the plurality of upright posts, a second side edge received in the track of another of the plurality of upright posts, and a lower edge adjacent the lower rail. The lower edge has a first length. Each panel also has an upper edge opposite the lower edge. The upper edge has a second length that is longer than the first length.

In another embodiment, the invention provides a workstation including a frame having a lower rail and a plurality of upright posts coupled to and extending upwardly from the lower rail. The lower rail has a curved shape that is fixed. The workstation also includes a plurality of panels supported by the frame. Each panel has a first side edge coupled to one of the plurality of upright posts, a second side edge coupled to another of the plurality of upright posts, a lower edge adjacent the lower rail, and an upper edge opposite the lower edge. Each panel is also bent between corresponding upright posts to match the curved shape of the lower rail.

In yet another embodiment, the invention provides a workstation including a frame having a lower rail and a plurality of upright posts coupled to and extending upwardly from the lower rail. Each upright post has a track. The lower rail has a curved shape that is fixed. The workstation also includes a plurality of panels supported by the frame. Each panel has a first side edge received in the track of one of the plurality of upright posts, a second side edge received in the track of another of the plurality of upright posts, and a lower edge adjacent the lower rail. The lower edge has a first length. Each panel also has an upper edge opposite the lower edge. The upper edge has a second length that is longer than the first length. Each panel is also bent between corresponding upright posts to match the curved shape of the lower rail.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
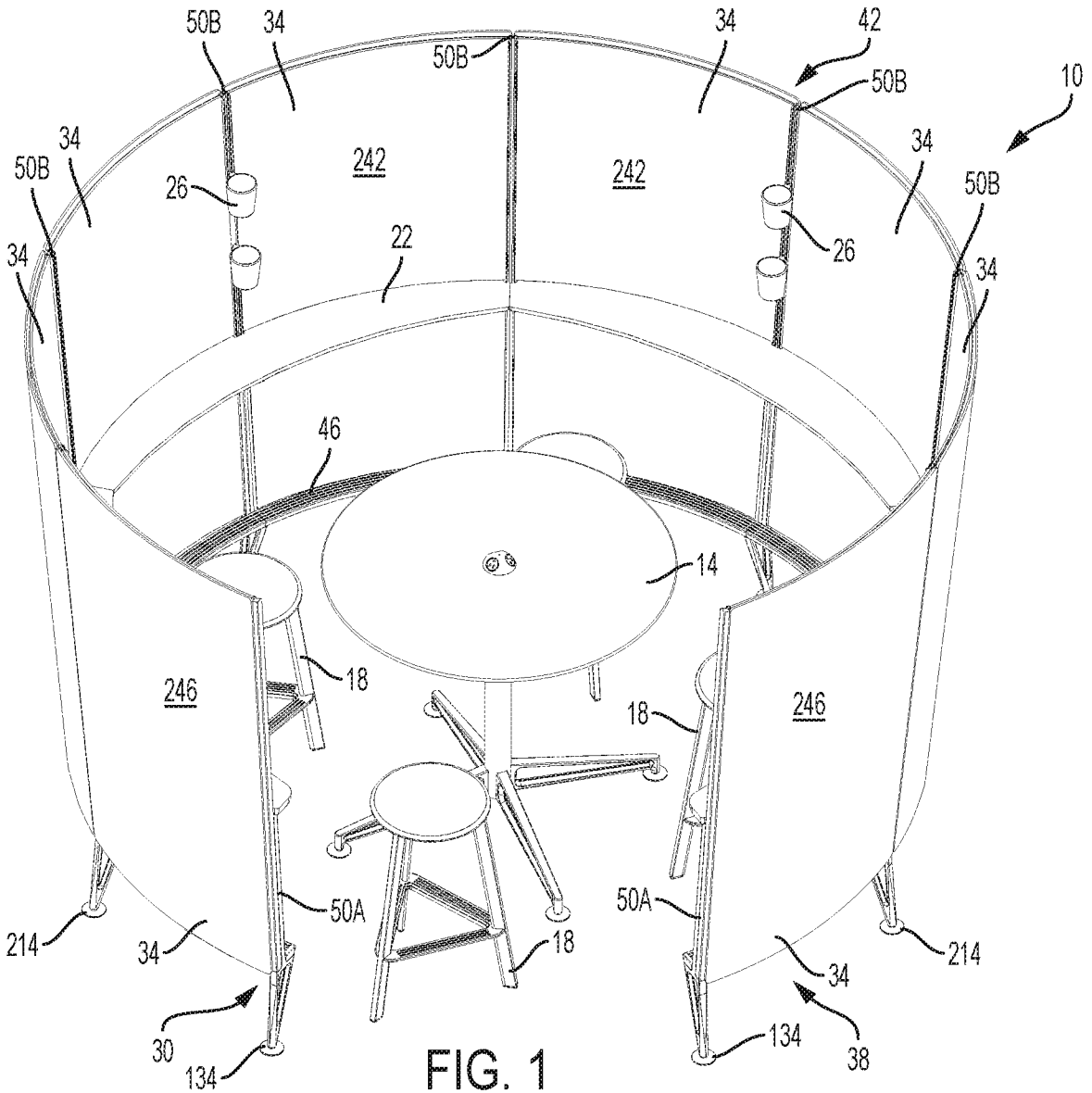
FIG. 1 is a perspective view of a workstation embodying the invention, the workstation including a frame and a plurality of panels.

FIG. 1 illustrates a workstation 10. The workstation 10 can be positioned within a building, such as an office, a school, a library, and the like, to provide space for individuals or groups of people to work and meet. The workstation 10 forms a partially enclosed space that provides at least some separation and privacy from the surrounding environment. Tables 14, chair and stools 18, and other furniture items can be positioned within the workstation 10 to enhance usability of the workstation 10. In addition, shelves 22, storage containers 26, lights, mounting brackets, and other accessories can be supported by the workstation 10 to increase the functionality of the workstation 10.

The illustrated workstation 10 includes a frame 30 and a plurality of panels 34. When assembled, the frame 30 and the panels 34 define the shape of the workstation 10. In the illustrated embodiment, the workstation 10 is generally cylindrical. More particularly, the workstation 10 is frusto-conically shaped, with a lower end 38 of the workstation 10 being smaller than an upper end 42 of the workstation 10, as further described below. In other embodiments, the workstation 10 may have other shapes. Once assembled, the overall shape of the workstation 10 is fixed or rigid. In addition, the workstation 10 is self-supporting. In the illustrated embodiment, the workstation 10 includes eight panels 34. In other embodiments, the workstation 10 may include fewer or more panels 34, depending on the desired shape and size of the workstation 10.

Figure 2:
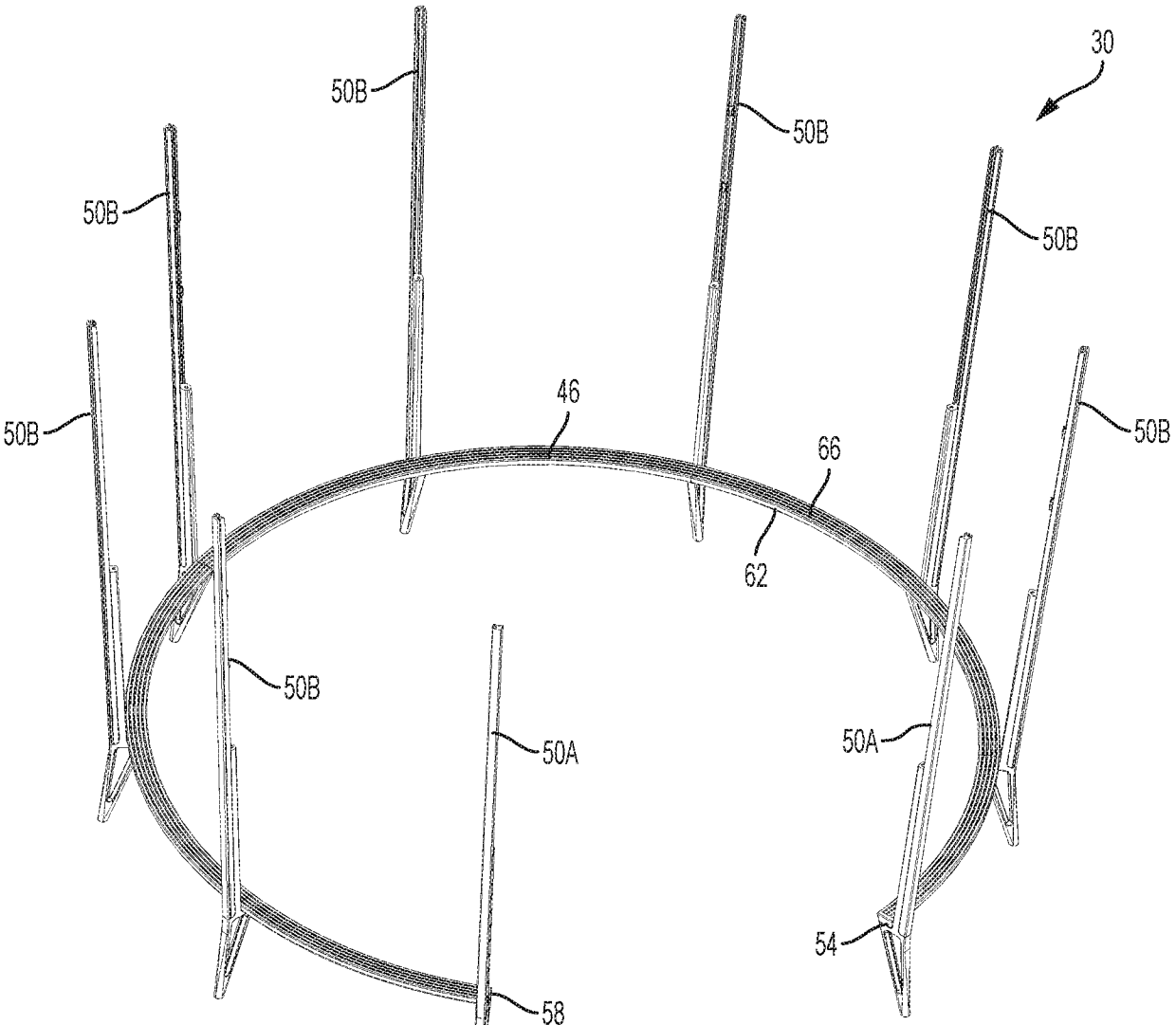
FIG. 2 is a perspective view of the frame shown in FIG. 1, the frame including a lower rail and a plurality of upright posts.

As shown in FIG. 2, the frame 30 includes a lower rail 46 and a plurality of upright posts 50A, 50B. The upright posts 50 are coupled to and extend upwardly from the lower rail 46. The lower rail 46 and the upright posts 50 are made of a relatively rigid material, such as metal (e.g., aluminum, steel, etc.), to support the panels 34. The lower rail 46 extends around the lower end 38 of the workstation 10 from a first end 54 to a second end 58. In the illustrated embodiment, the lower rail 46 is defined by a plurality of segments that are coupled together. In other embodiments, the lower rail 46 may be a single, continuous rail extending around the lower end 38 of the workstation 10. The lower rail 46 includes a lower surface 62 facing toward the floor, and an upper surface 66 facing away from the floor. In some embodiments, the upper surface 66 provides a footrest for individuals within the workstation.

The lower rail 46 generally defines the shape of the workstation 10. In the illustrated embodiment, the lower rail 46 has a curved shape that is fixed. That is, the lower rail 46 has a shape that remains stationary once assembled and is not adjustable by an end user. The curved shape of the lower rail 46 is an arc that extends around almost an entire circle. In other embodiments, the lower rail 46 may have other shapes or arc lengths, as desired for the shape of the workstation 10.

Figure 3:
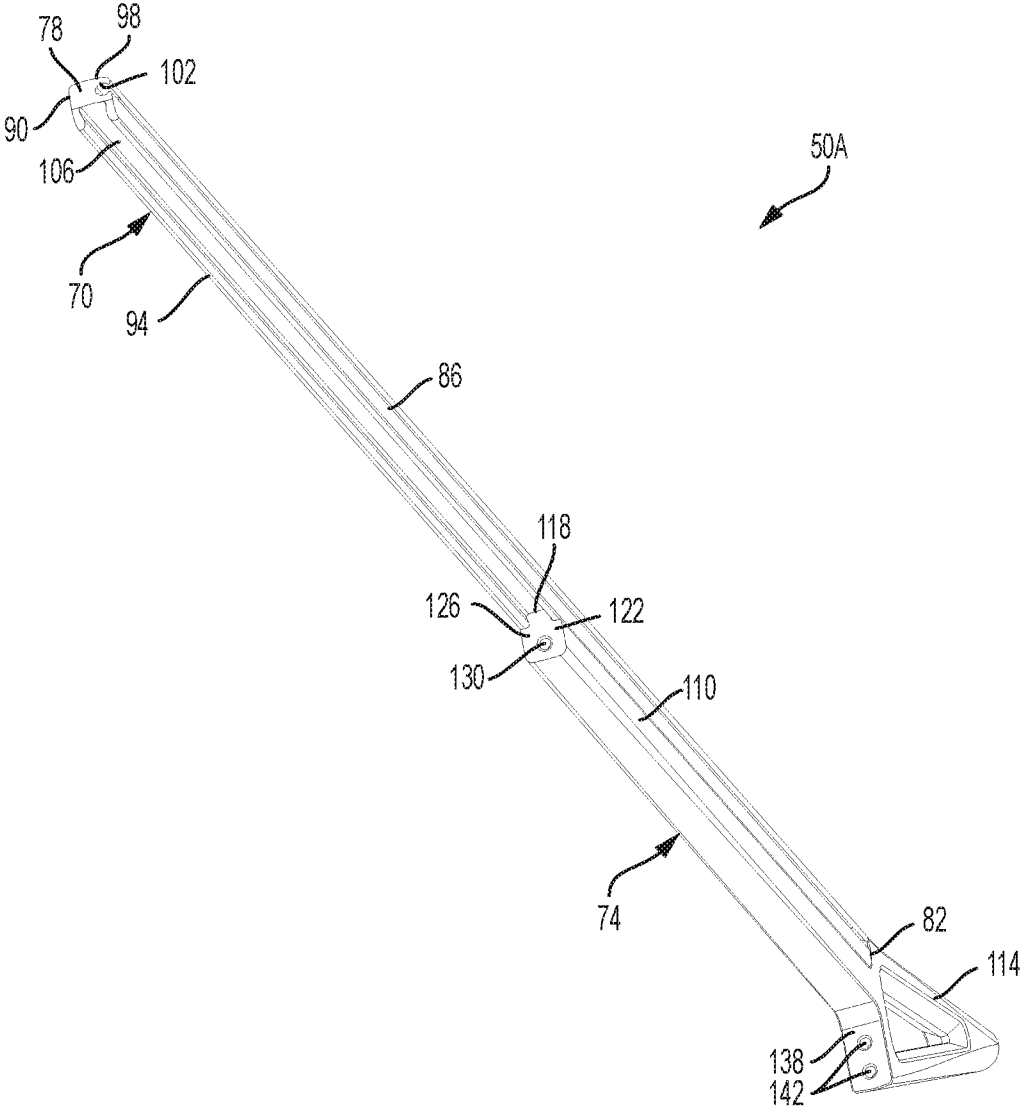
FIG. 3 is a perspective view of one of the upright posts shown in FIG. 2, the upright post including a track.

FIG. 3 illustrates one of the upright posts 50A of the frame 30. The illustrated upright post 50A is an end post of the frame 30 and is positioned at the second end 58 of the lower rail 46. It should be understood that the upright post 50A at the first end 54 of the lower rail 46 is substantially similar to, but a mirror image of the illustrated upright post 50A. The upright post 50A includes a main body 70 and a leg 74. The main body 70 extends generally perpendicularly from the lower rail 46, upward from the lower rail 46. In the illustrated embodiment, the main body 70 has a generally parallelepiped structure, such as a rectangular cuboid. In other embodiments, the main body 70 may have other desired shapes. The illustrated main body 70 includes an upper end 78, a lower end 82, a first side 86, a second side 90, a third side 94, and a fourth side 98. The main body 70 also includes a track 102 formed in the first side 86. In the illustrated embodiment, the track 102 is defined by a generally circular aperture, or opening, that extends from the upper end 78 of the main body 70 to the lower end 82. The track 102 extends the length of the main body 70 in a longitudinal direction of the upright post 50A. The track 102 is configured to receive an edge of one of the panels 34, as further described below.

The main body 70 further includes a channel 106 formed in the third side 94. In the illustrated embodiment, the channel 106 is defined by a generally rectangular aperture, or opening, that extends from the upper end 78 of the main body 70 to the lower end 82. The channel 106 extends the length of the main body 70 in the longitudinal direction of the upright post 50A. The channel 106 is configured to receive part of the leg 74. In addition, the channel 106 is configured to receive accessories, such as the storage containers 26 (FIG. 1), to releasably couple the accessories to the workstation 10.

The illustrated leg 74 includes an upper column 110 and a lower support 114. The upper column 110 extends in a direction parallel to the longitudinal direction of the upright post 50A. The upper column 110 includes a projection 118 that is received in the channel 106 of the main body 70 to help align the leg 74 with the main body 70. In the illustrated embodiment, the upper column 110 extends approximately halfway up the main body 70 and defines an upper end 122 of the leg 74. In other embodiments, the upper column 110 may extend along the main body 70 a longer or shorter distance. The upper end 122 of the leg 74 forms a first mounting surface 126. The first mounting surface 126 is configured to support the shelf 22 (FIG. 1) of the workstation 10 above the lower rail 46. In particular, the first mounting surface 126 defines an aperture 130 so the shelf 22 can be secured to the first mounting surface 126 with a threaded fastener (e.g., a bolt). In some embodiments, a bracket with a bag hook (similar to bag hook 334 shown in FIG. 11) may be positioned between the first mounting surface 126 and the shelf 22. In such embodiments, the bracket also helps securely mount the shelf 22 to the upright post 50A.

The lower support 114 extends at an angle from the upper column 110, downward from the lower rail 46. In the illustrated embodiment, the lower support 114 has a generally triangular shape. In other embodiments, the lower support 114 may have other desired shapes. The lower support 114 is coupled to a foot 134 (FIG. 1), such as a height-adjustable pad, to support the lower rail 46 above the floor. The leg 74 also includes a second mounting surface 138 formed at a junction between the upper column 110 and the lower support 114. The second mounting surface 138 is configured to support the lower rail 46. In particular, the second mounting surface 138 defines apertures 142 so the lower rail 46 can be secured to the second mounting surface 138 with threaded fasteners (e.g., bolts).

Figure 4:
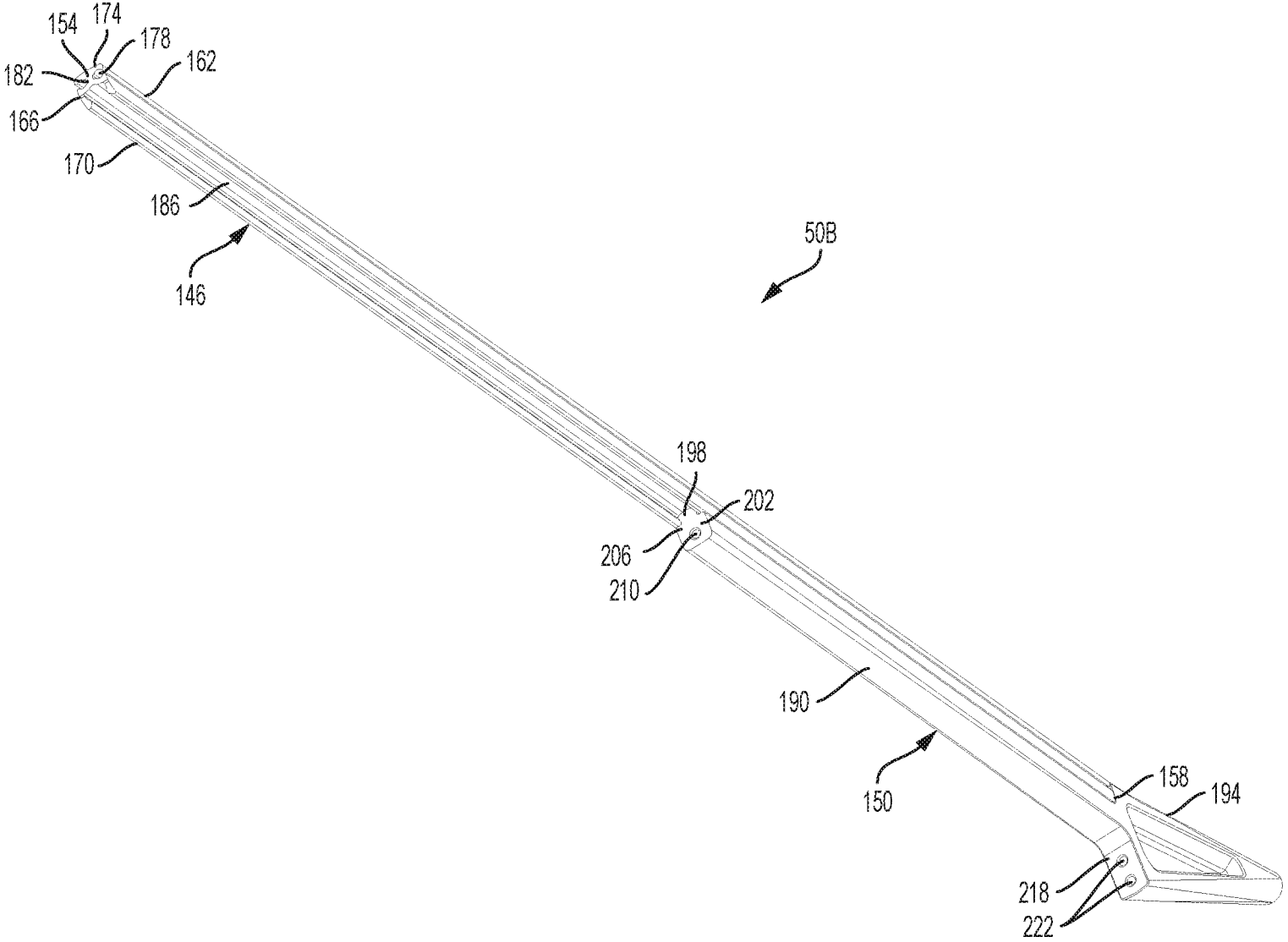
FIG. 4 is a perspective view of another one of the upright posts shown in FIG. 2, the upright post including two tracks.

FIG. 4 illustrates another one of the upright posts 50B of the frame 30. The illustrated upright post 50B is an intermediate post of the frame 30 that is positioned between the first end 54 and the second end 58 of the lower rail 46. It should be understood that the other intermediate upright posts 50B of the frame 30 are substantially similar to the illustrated upright post 50B. The upright post 50B includes a main body 146 and a leg 150. The main body 146 extends generally perpendicularly from the lower rail 46, upward from the lower rail 46. In the illustrated embodiment, the main body 146 has a generally parallelepiped structure, such as a rectangular cuboid. In other embodiments, the main body 146 may have other desired shapes. The illustrated main body 146 includes an upper end 154, a lower end 158, a first side 162, a second side 166, a third side 170, and a fourth side 174. The main body 146 also includes a first track 178 formed in the first side 162 and a second track 182 formed in the second side 166. In the illustrated embodiment, the tracks 178, 182 are defined by generally circular apertures, or openings, that extend from the upper end 154 of the main body 146 to the lower end 158. The tracks 178, 182 extend the length of the main body 146 in a longitudinal direction of the upright post 50B. The tracks 178, 182 are configured to receive edges of adjacent panels 34, as further described below.

The main body 146 further includes a channel 186 formed in the third side 170. In the illustrated embodiment, the channel 186 is defined by a generally rectangular aperture, or opening, that extends from the upper end 154 of the main body 146 to the lower end 158. The channel 186 extends the length of the main body 146 in the longitudinal direction of the upright post 50B. The channel 186 is configured to receive part of the leg 150. In addition, the channel 186 is configured to receive accessories, such as the storage containers 26 (FIG. 1), to releasably couple the accessories to the workstation 10.

The illustrated leg 150 includes an upper column 190 and a lower support 194. The upper column 190 extends in a direction parallel to the longitudinal direction of the upright post 50B. The upper column 190 includes a projection 198 that is received in the channel 186 of the main body 146 to help align the leg 150 with the main body 146. In the illustrated embodiment, the upper column 190 extends approximately halfway up the main body 146 and defines an upper end 202 of the leg 150. In other embodiments, the upper column 190 may extend along the main body 146 a longer or shorter distance. The upper end 202 of the leg 150 forms a first mounting surface 206. The first mounting surface 206 is aligned with (i.e., at the same height as) the first mounting surface 126 of the upright post 50A shown in FIG. 3 and is configured to support the shelf 22 (FIG. 1) above the lower rail 46 of the workstation 10. In particular, the first mounting surface 206 defines an aperture 210 so the shelf 22 can be secured to the first mounting surface 206 with a threaded fastener (e.g., a bolt). In some embodiments, a bracket with a bag hook (similar to bag hook 334 shown in FIG. 11) may be positioned between the first mounting surface 126 and the shelf 22. In such embodiments, the bracket also helps securely mount the shelf 22 to the upright post 50B.

The lower support 194 extends at an angle from the upper column 190, downward from the lower rail 46. In the illustrated embodiment, the lower support 194 has a generally triangular shape. In other embodiments, the lower support 194 may have other desired shapes. The lower support 194 is coupled to a foot 214 (FIG. 1), such as a height-adjustable pad, to support the lower rail 46 above the floor. The leg 150 also includes a second mounting surface 218 formed at a junction between the upper column 190 and the lower support 194. The second mounting surface 218 is aligned with (i.e., at the same height as) the second mounting surface 138 of the upright post 50A shown in FIG. 3 and is configured to support the lower rail 46. In particular, the second mounting surface 218 defines apertures 222 so the lower rail 46 can be secured to the second mounting surface 218 with threaded fasteners (e.g., bolts).

Figure 5:
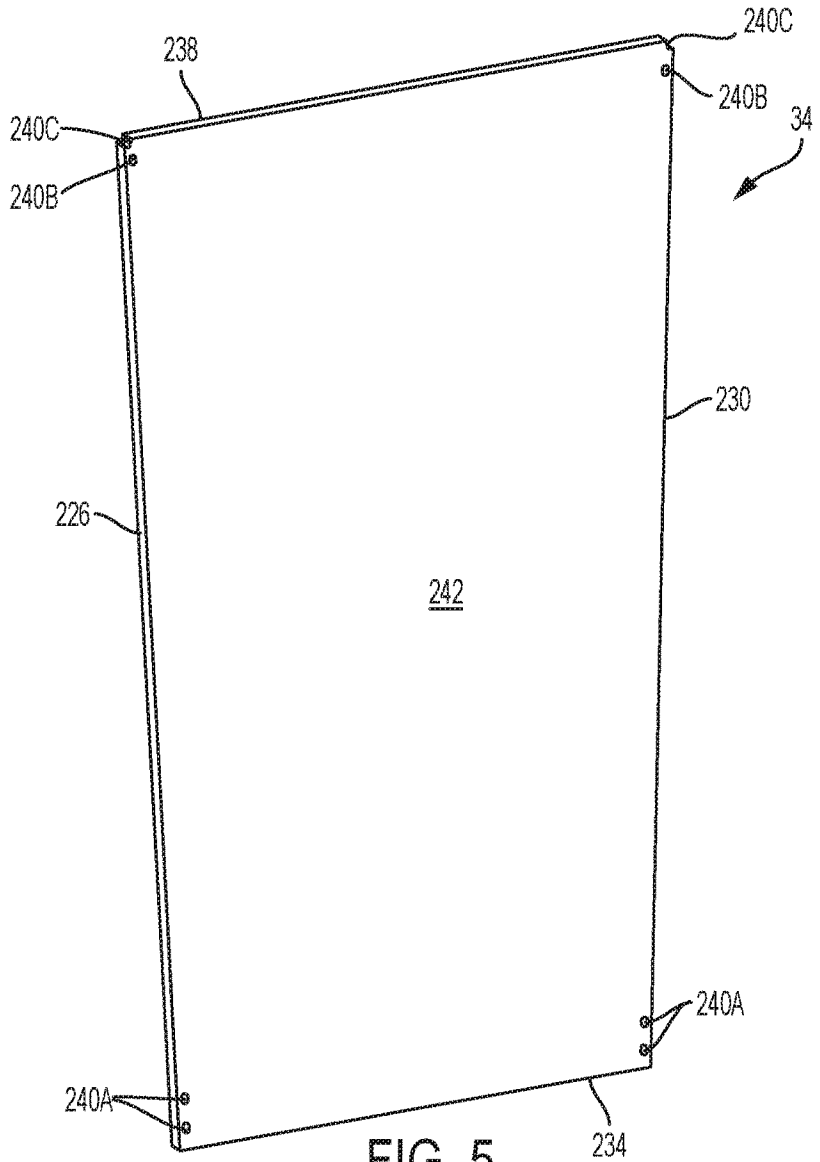
FIG. 5 is a perspective view of one of the panels shown in FIG. 1.
Figure 6:
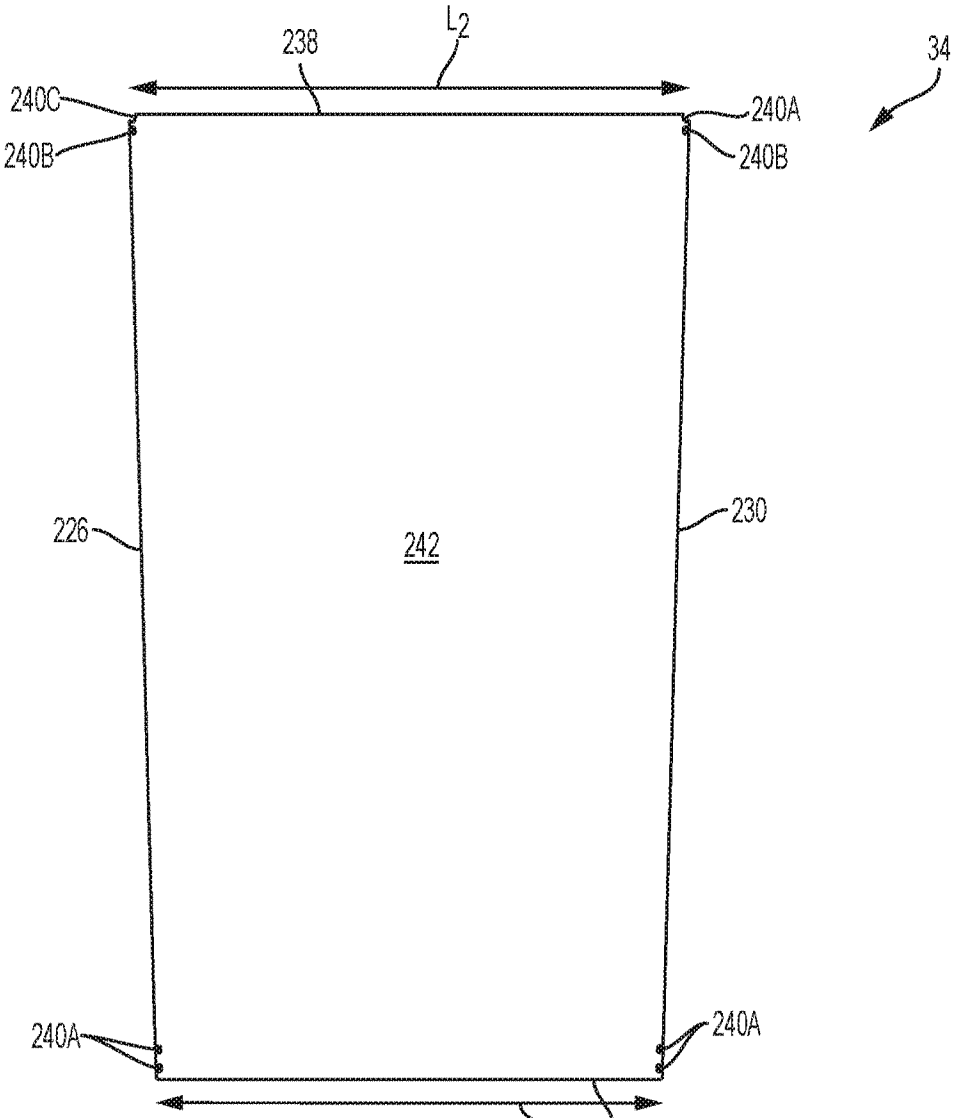
FIG. 6 is a front view of the panel shown in FIG. 5.

FIGS. 5 and 6 illustrate one of the panels 34. It should be understood that the other panels 34 are substantially similar to the illustrated panel 34. The panel 34 is rigid, but flexible. In other words, the panel 34 is strong enough to support a load, yet can be bent or flexed to fit between the uptight posts 50A, SOB of the frame 30. In some embodiments, the panel 34 may be made of, for example, an aluminum composite material (ACM) that consists of two thin (e.g., 0.5 mm or less) aluminum sheets bonded to a non-aluminum core. In other embodiments, the panel 34 may be made of other suitable materials, such as sheet metal, plastic, wood, particle board, rigid cardboard, composite materials, and the like.

The illustrated panel 34 includes a first side edge 226, a second side edge 230, a lower edge 234, and an upper edge 238. The first and second side edges 226, 230 extend between the lower edge 234 and the upper edge 238. The first and second side edges 226, 230 are configured to be received in the tracks 102, 178, 182 of the upright posts 50A, 50B to couple the panel 34 to the frame 30. In the illustrated embodiment, the first and second side edges 226, 230 are linear and continuous. In other embodiments, the first and second side edges 226, 230 may be non-linear or discontinuous. The lower edge 234 is positioned adjacent the lower rail 46 when the panel 34 is supported by the frame 30. The lower edge 234 has a first length $L_1$. The upper edge 238 is positioned adjacent the upper ends 78, 154 of the upright posts 50A, 50B when the panel 34 is supported by the frame 30. The upper edge 238 has a second length $L_2$. In the illustrated embodiment, the second length $L_2$ is longer than the first length $L_1$ such that the panel 34 is generally trapezoidal, or keystone, shaped. The panel 34 also includes notches 240A, 240B, 240C formed in the side edges 226, 230 near the lower edge 234 and near the upper edge 238. As further explained below, the notches 240A, 240B, 240C receive clips, or other features, that lock within the tracks 102, 178, 182 of the upright posts 50A, 50B to help secure the panels 34 within the tracks 102, 178, 182.

The panel 34 also includes a first face 242 and a second face 246 (FIG. 1). The first face 242 is an inner face of the panel 34 and faces toward the center of the workstation 10. The second face 246 is an outer face of the panel 34 and faces outwardly from the workstation 10. In some embodiments, the first face 242 may include a whiteboard surface. For example, the first face 242 may be painted with a base coat (e.g., white paint) and a clear performance coating. The whiteboard surface allows a user to write on and erase markings from the first face 242. In other embodiments, the first face 242 may include a different surface treatment, such as fabrics, paints, tiles, mirrors, and the like. The second face 246 may also include a whiteboard surface, may include a different surface treatment, or may include no surface treatment. The surface treatments may be integrated onto the faces 242, 246 of the panel 34, or may be removably coupled to the faces 242, 246 of the panel 34.

Figure 6B:
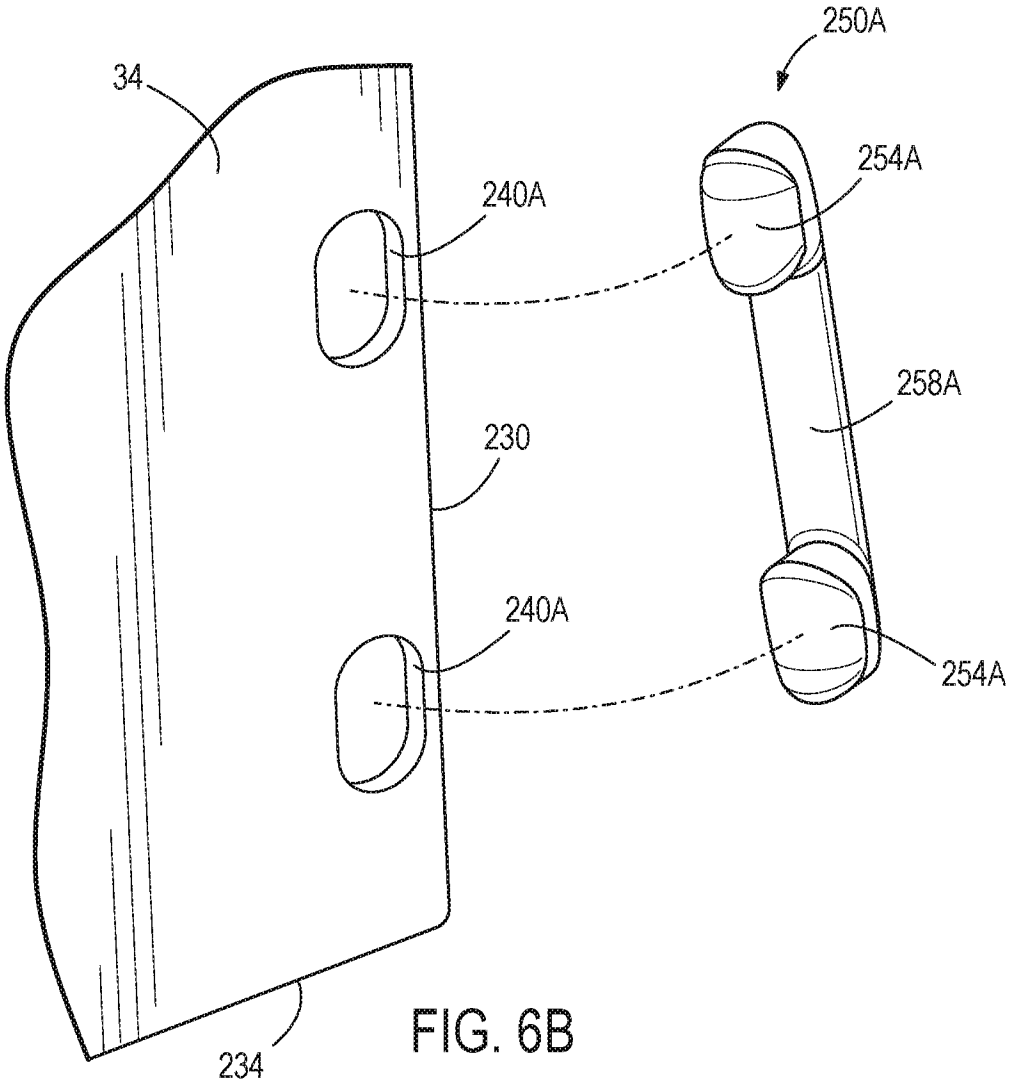
FIG. 6B is an enlarged view of a lower portion of the panel of FIG. 5.

FIG. 6B illustrates the panel 34 having the notches 240A near the lower edge 234 of the panel 34. Both of the notches 240A are spaced slightly inward from the side edge 230 of the panel 34 so that the notches 240A are completely bounded by the panel 34. Each set of notches 240A, 240B, 240C receives a clip 250A, 250B. The illustrated clip 250A includes two bosses 254A and an elongated body 258A extending between the bosses 254A. The bosses 254A are received in the notches 240A. When the panel 34 is fully inserted into the tracks 102, 178, 182 of the upright posts 50A, 50B, the elongated body 258A engages inner surfaces of the posts 50A, 50B defining the tracks 102, 178, 182 to lock the panel 34 in place. In some embodiments, the clip 250A, 250B may be made of, for example, plastic. Additionally or alternatively, other clips that engage the notches 240A, 240B, 240C and the tracks 102, 178, 182 may alternatively be used, and/or the panel 34 may only include a single notch 240 near each corner to receive the clip 250A, 250B.

Figure 6C:
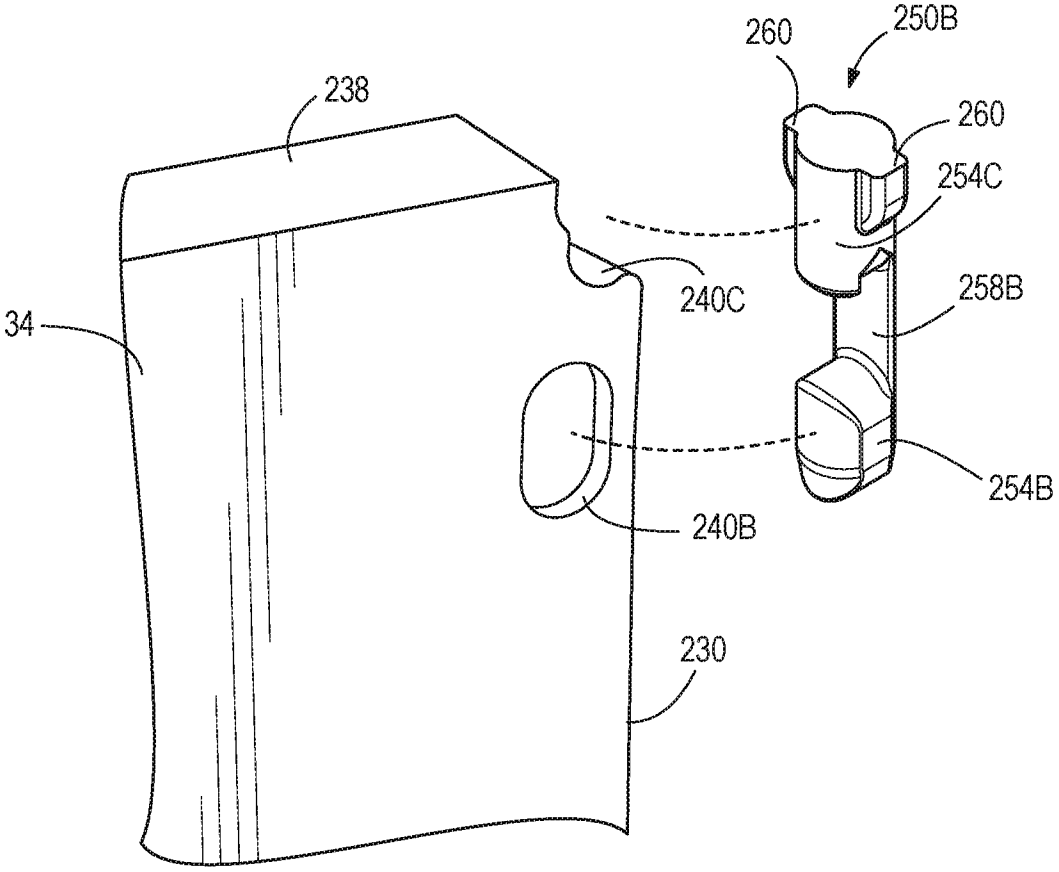
FIG. 6C is an enlarged view of an upper portion of the panel of FIG. 5.

FIG. 6C illustrates the panel 34 having the notches 240B, 240C near the upper edge 238. Specifically, the notch 240B is spaced slightly inward from the side edge 230 such that the notch 240B is completely bounded, and the notch 240C is in connection with the side edge 230 such that the notch 240C is not bounded. The illustrated notch 240C is also in connection with the upper edge 238. The illustrated clip 250B includes two bosses 254B, 254C and an elongated body 258B extending between the bosses 254B, 254C. The bosses 254B, 254C are received in the notches 240B, 240C, respectively. Furthermore, the boss 254C includes two projections 260. The projections 260 extend from opposite sides of the boss 254C. As discussed above, when the panel 34 is fully inserted into the tracks 102, 178, 182 of the upright posts 50A, 50B, the elongated body 258B engages inner surfaces of the posts 50A, 50B defining the tracks 102, 178, 182 to lock the panel 34 in place. Furthermore, the projections 260 are received within respective grooves of the tracks 102, 178, 182. The boss 254C and the projections 260 may fill in the space at a top of the track 102, 178, 182.

Figure 7:
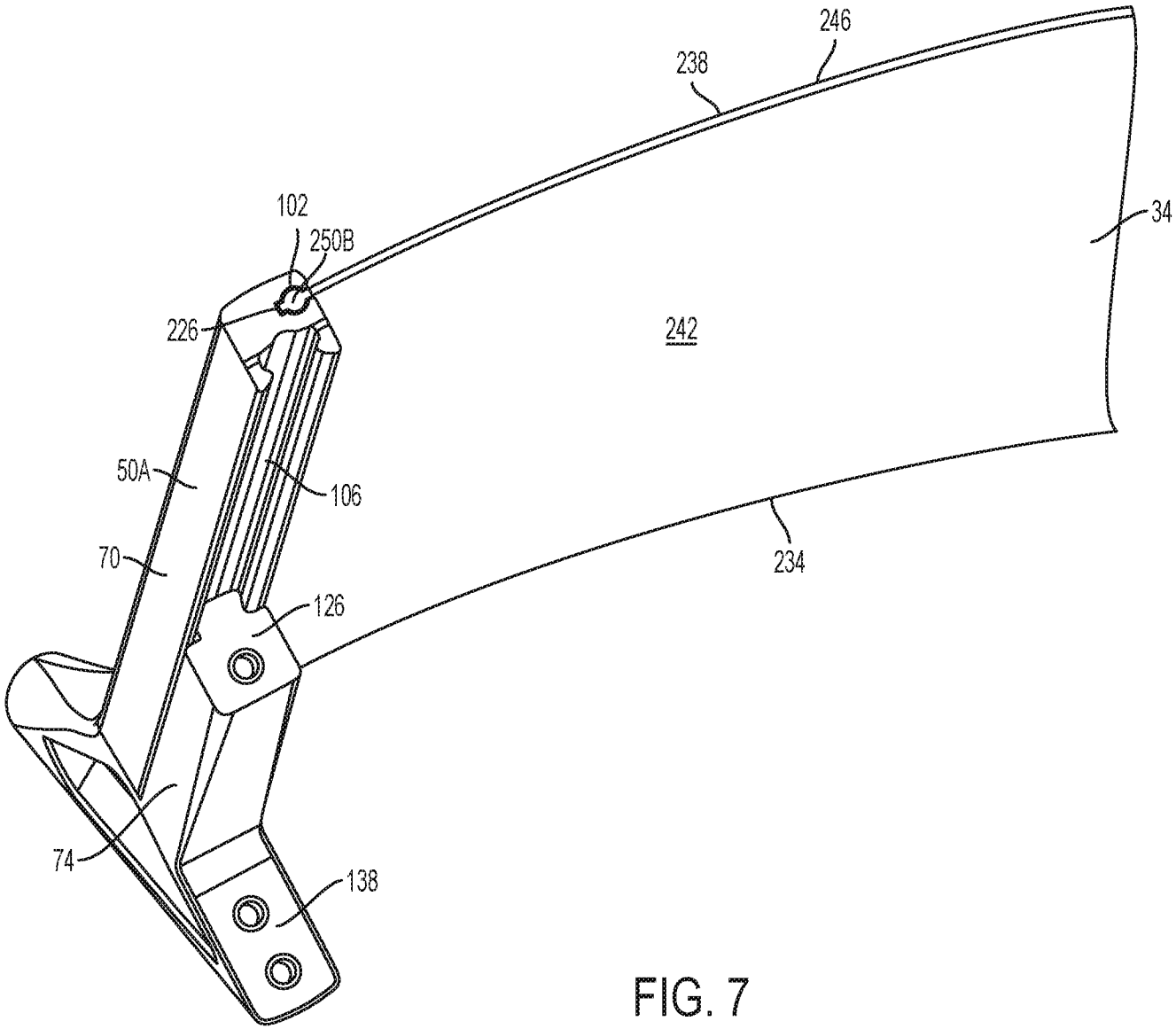
FIG. 7 is a perspective view of the upright post shown in FIG. 3 receiving an edge of the panel shown in FIG. 6.
Figure 8:
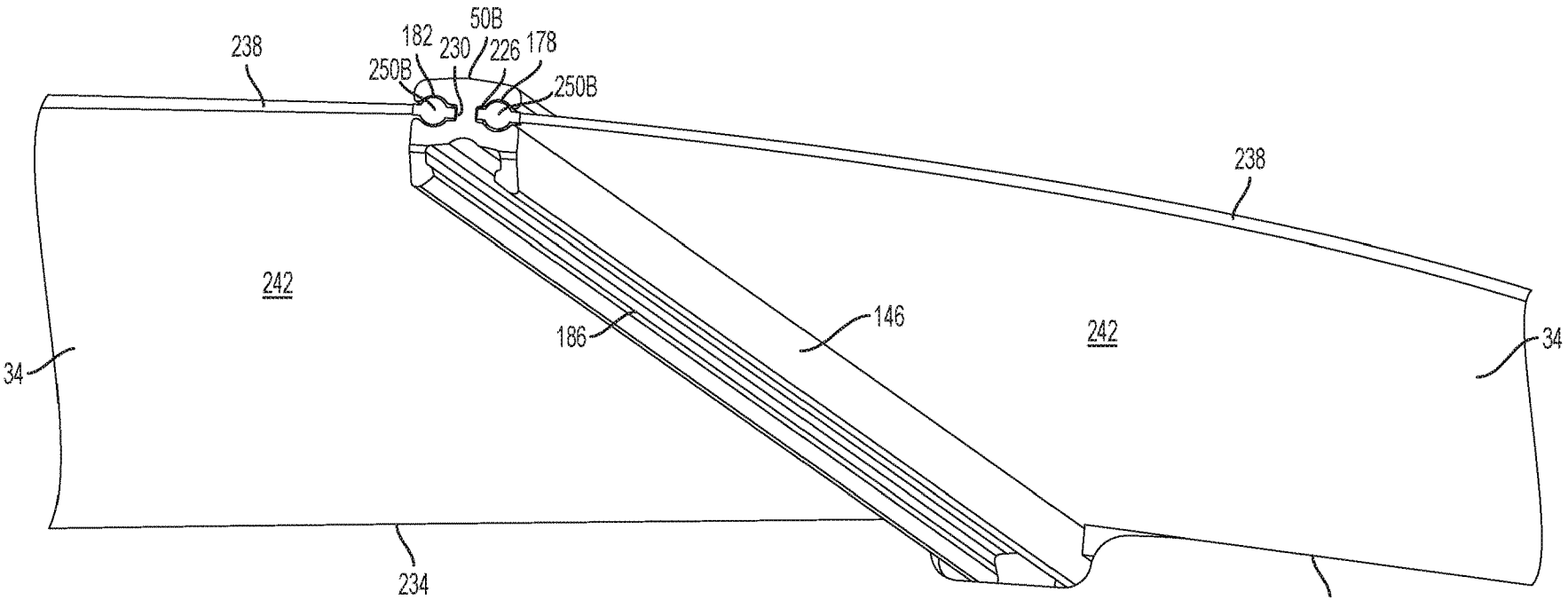
FIG. 8 is a perspective view of the upright post shown in FIG. 4 receiving edges of two adjacent panels.
Figure 9:
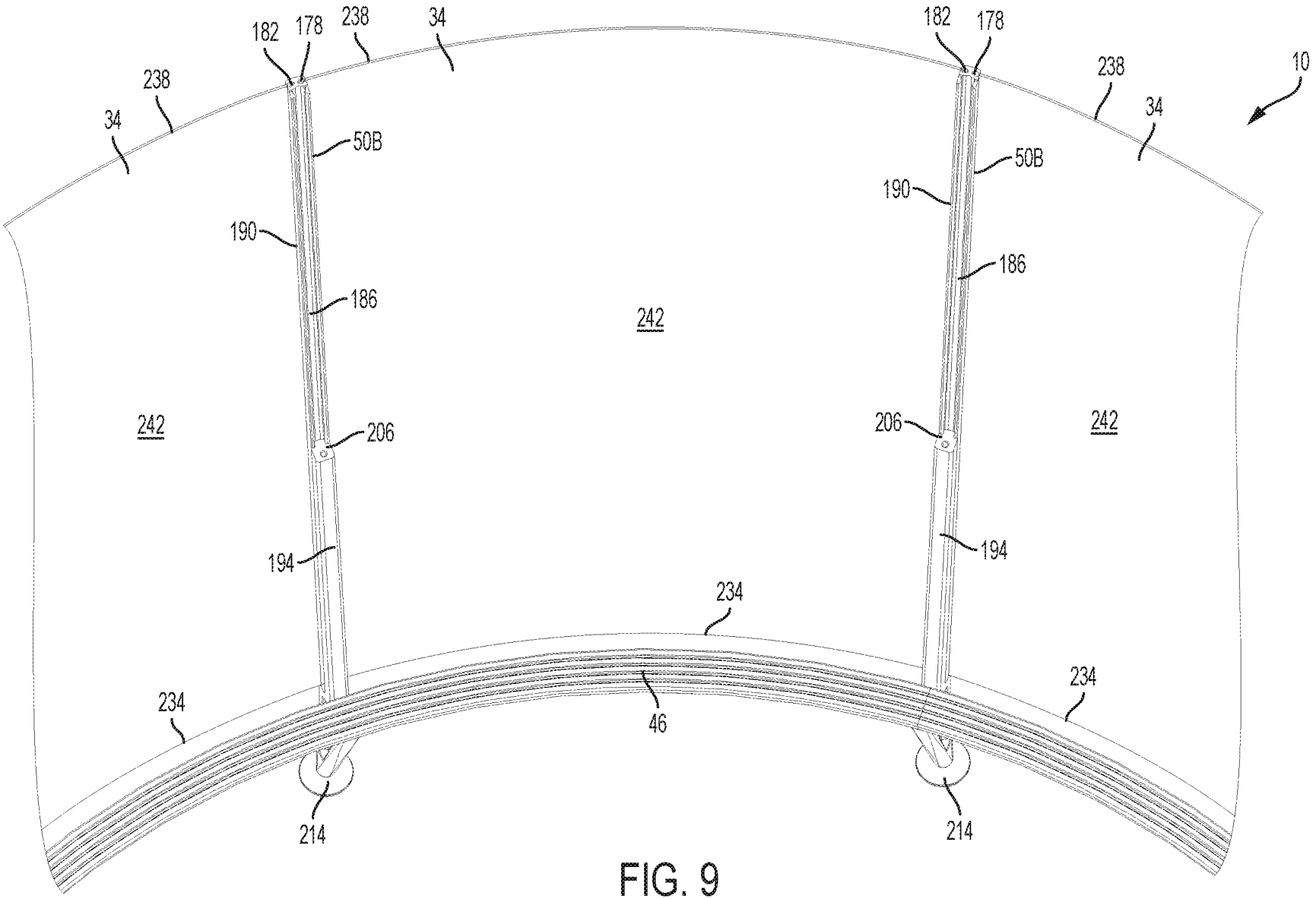
FIG. 9 is a perspective view of a portion of the workstation of FIG. 1, illustrating a panel received between adjacent upright posts.

FIGS. 7-9 illustrate the panels 34 coupled to the frame 30. The panels 34 are configured to slide into the tracks 102, 178, 182 of the upright posts 50A, 50B from above (e.g., from the upper end 42 of the workstation 10, opposite the lower rail 46). As shown in FIG. 7, the first side edge 226 of the panel 34 is received in the track 102 of the upright post 50A, and the clip 250B secures the panel 34 within the track 102 of the post 50A. As shown in FIG. 8, the first side edge 226 of one panel 34 is received in the first track 178 of the upright post 50B, and the second side edge 230 of an adjacent panel 34 is received in the second track 182 of the upright post 50B. Each clip 250B secures the panel 34 and the adjacent panel 34 within the respective track 178, 182 of the post 50B. The trapezoidal shape of the panels 34 (i.e., the lower edge 234 of each panel 34 being shorter than the upper edge 238) helps the panels 34 slide into the frame 30 between the upright posts 50A, 50B. For example, since the lower edges 234 of the panels 34 are shorter than the distance between the upright posts 50A, 50B at the upper end 42 of the workstation 10, the panels 34 can initially slide into the tracks 102, 178, 182 of the uprights posts 50A, 50B with little or no friction. The panels 34 do not fit tightly within the upright posts 50A, 50B until the panels 34 are completely, or nearly completely, slid down the upright posts 50A, 50B.

In addition, the panels 34 can bend to fit between the upright posts 50A, 50B and match the curved shape of the lower rail 46. In the illustrated embodiment, the panels 34 are bent so the first face 242 of each panel 34 has a concave shape and the second face 246 of each panel 34 has a convex shape. In other embodiments, the panels 34 may be bent in other directions (e.g., the second faces 246 may be concave, and the first faces 242 may be convex), depending on the shape of the workstation 10. When assembled, the panels 34 are held in compression (e.g., held in bent or curved shapes so the side edges 226, 230 of the panels 34 are brought toward each other) between the upright posts 50A, 50B. On the other hand, since the panels 34 naturally try to return to an unbent state, the frame 34 (and, particularly, the upright posts 50A, 50B) is held in tension between the panels 34. This arrangement of the panels 34 being held in compression (i.e., the panels 34 being bent) and the frame 30 being held in tension (i.e., the upright posts 50A, 50B being spread apart) makes the workstation 10 substantially rigid and solid.

In some embodiments, a set screw may be inserted into the tracks 102, 178, 182 of the upright posts 50A, 50B. The set screws can be positioned above the panels 34 to help secure the panels 34 within the upright posts 50A, 50B, inhibiting accidental removal of the panels 34 from the frame 30. Additionally or alternatively, a trim piece may be coupled to the upper end 42 of the workstation 10. The trim piece can be coupled to the upper ends 78, 154 of the upright posts 50A, 50B and to the upper edges 238 of the panels 34. The trim piece can provide a smooth and/or decorative edge at the upper end 42 of the workstation 10. Further, the trim piece may help hold the panels 34 within the frame 30.

Figure 10:
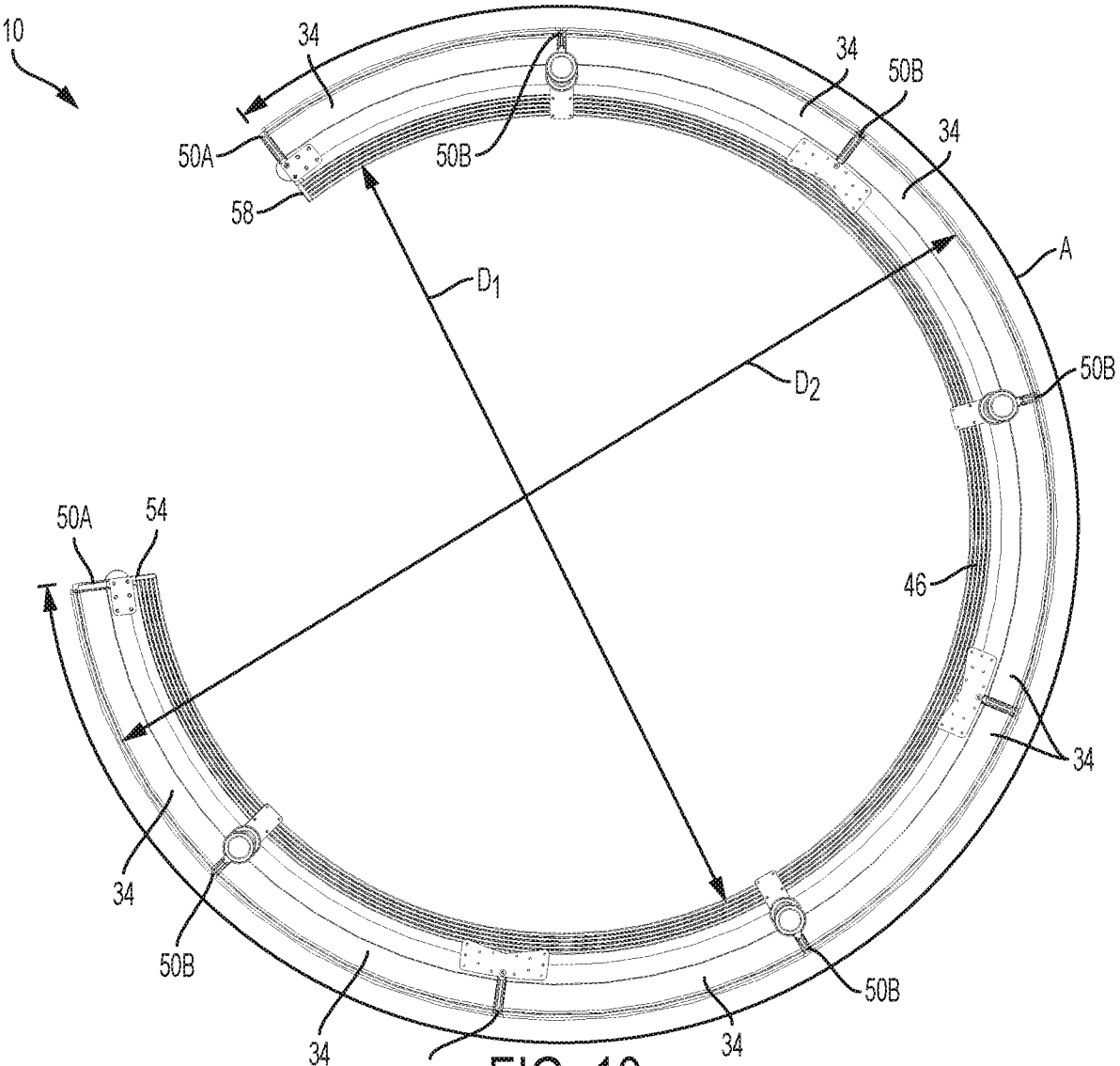
FIG. 10 is a top view of the workstation of FIG. 1.

As shown in FIG. 10, after the frame 30 and the panels 34 are assembled, the workstation 10 is generally circular when viewed from above. More particularly, the workstation 10 extends through an arc A, as defined by the curved shape of the lower rail 46. In the illustrated embodiment, the arc A extends through an angle of about 300 degrees from the first end 54 of the lower rail 46 to the second end 58 of the lower rail 46. In other embodiments, the arc A may extend through a smaller angle or through a larger angle than 300 degrees.

As noted above, the workstation 10 is also frustoconically shaped. In other words, the lower end 38 of the workstation 10 has a smaller diameter than the upper end 42 of the workstation 10. In the illustrated embodiment, the lower rail 46 defines a lower diameter $D_1$ of the workstation 10, and the upper edges 238 of the panels 34 define an upper diameter $D_2$ of the workstation 10. The upper diameter $D_2$ is larger than the lower diameter $D_1$ so that the workstation 10 tapers outwardly toward the upper end 42. In the illustrated embodiment, the degree of taper of the workstation 10 is generally constant from the lower rail 46 to the upper edges 238 of the panels 34. In other embodiments, the workstation 10 may taper unevenly between the lower rail 46 and the upper edges 238 of the panels 34. In further embodiments, the lower diameter $D_1$ and the upper diameter may be similar or equal so that the workstation 10 has little or no taper. For example, in the illustrated embodiment, the degree of taper is about 5 degrees. In other embodiments, the degree of taper may be between 0 degrees and 30 degrees, or may be 0 degrees.

Figure 11:
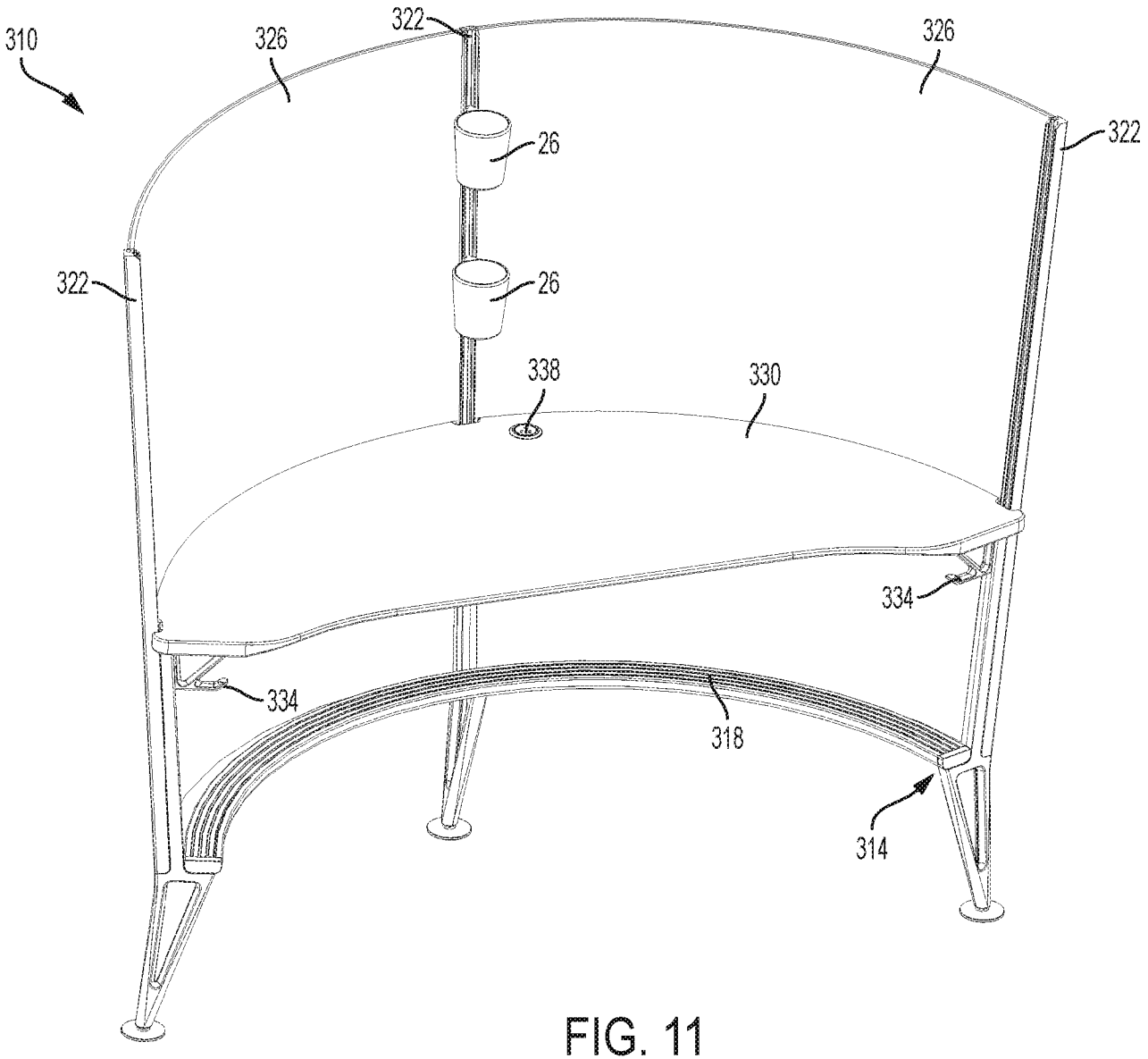
FIG. 11 is a perspective view of another workstation embodying the invention.
Figure 12:
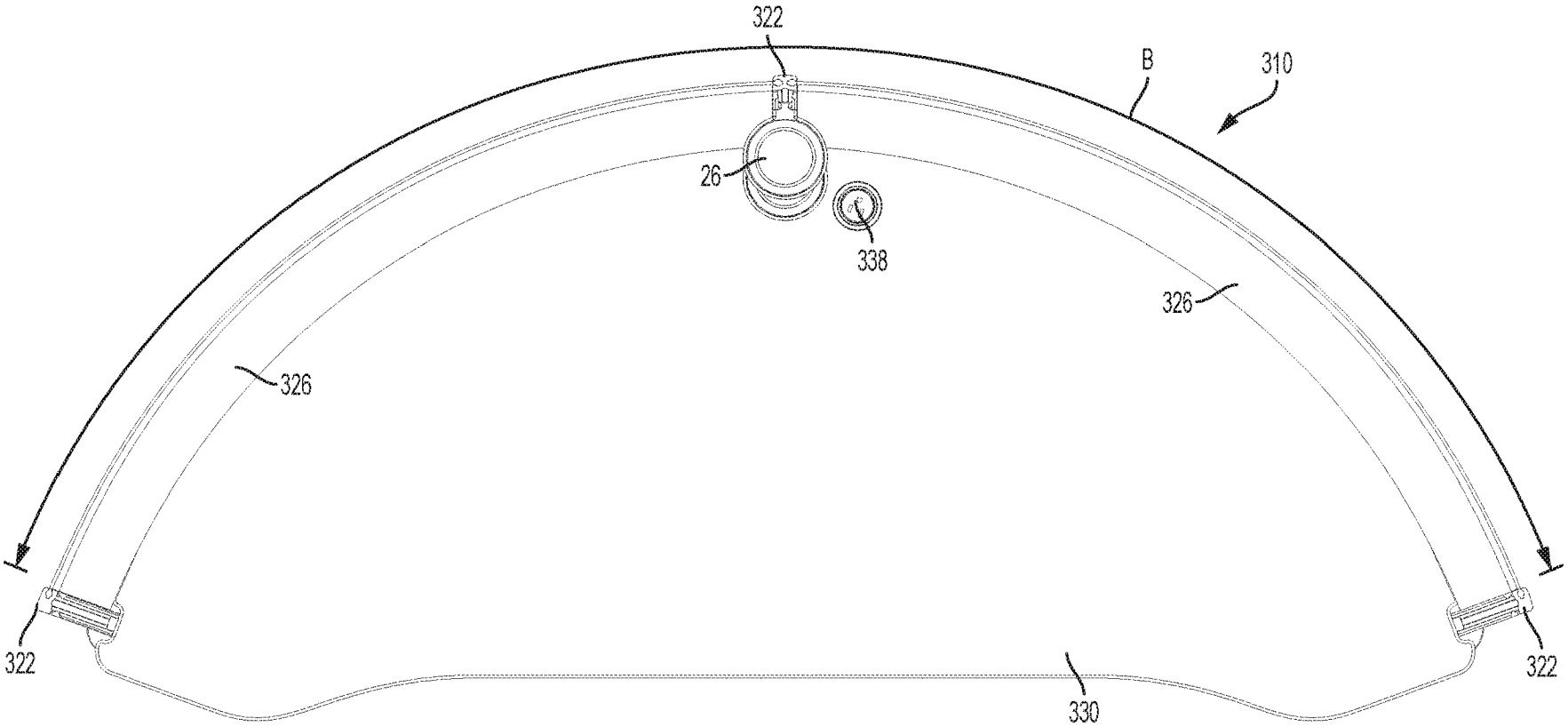
FIG. 12 is a top view of the workstation as shown in FIG. 11.

FIGS. 11 and 12 illustrate another workstation 310. Similar to the workstation 10 described above with reference to FIGS. 1-10, the illustrated workstation 310 includes a frame 314 having a lower rail 318 and a plurality of upright posts 322, and a plurality of panels 326. The frame 314 and the panels 326 are constructed in a manner similar to the frame 30 and panels 34 discussed above. In the illustrated embodiment, however, the workstation 310 only includes three upright posts 322 and two panels 326 so the workstation 310 extends through an arc B of less than 300 degrees. The illustrated arc B is about 140 degrees.

The illustrated workstation 310 also includes a table 330, or desk, supported by the upright posts 322 above the lower rail 318. The table 330 spans across the entire workstation 310. The table 330 provides a worksurface for a user seated in a chair at the workstation 310. In some embodiments, the table 330 may include additional accessories for the workstation 310, such as bag hooks 334 or power outlets 338.

Figure 13:
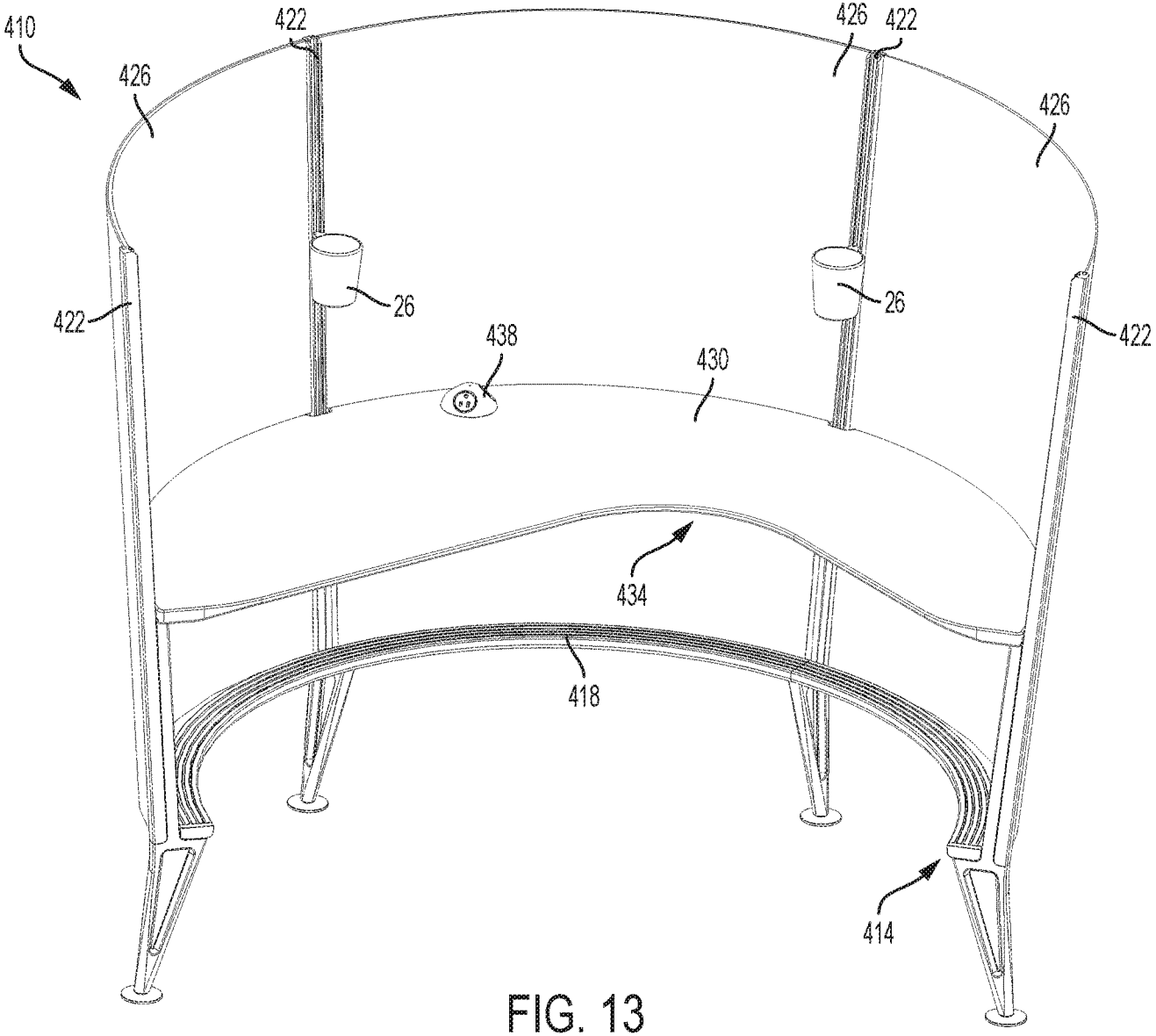
FIG. 13 is a perspective view of yet another workstation embodying the invention
Figure 14:
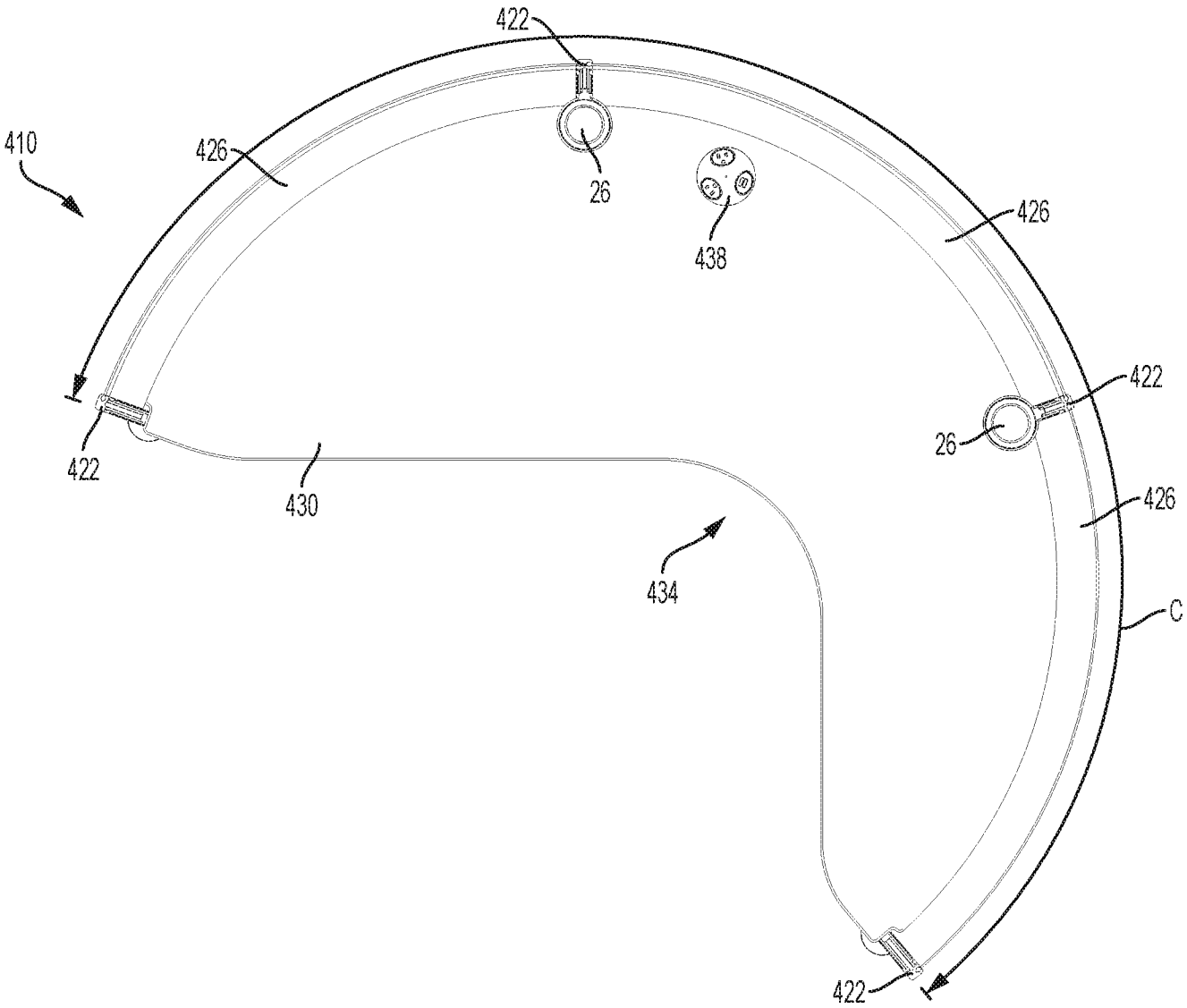
FIG. 14 is a top view of the workstation as shown in FIG. 13.

FIGS. 13 and 14 illustrate another workstation 410. Similar to the workstation 10 described above with reference to FIGS. 1-10, the illustrated workstation 410 includes a frame 414 having a lower rail 418 and a plurality of upright posts 422, and a plurality of panels 426. The frame 414 and the panels 426 are constructed in a manner similar to the frame 30 and the panels 34 discussed above. In the illustrated embodiment, however, the workstation 410 only, includes four upright posts 422 and three panels 426 so the workstation 410 extends through an arc C of less than 300 degrees. The illustrated arc C is about 215 degrees.

The illustrated workstation 410 also includes a table 430, or desk, supported by the upright posts 422 above the lower rail 418. The table 430 spans across the entire workstation 410 and includes a recessed area 434 approximately midway across the table 430. The table 430 provides a worksurface for a user seated in a chair at the workstation 410. In some embodiments, the table 430 may include additional accessories for the workstation 410, such as power outlets 438.

Figure 15:
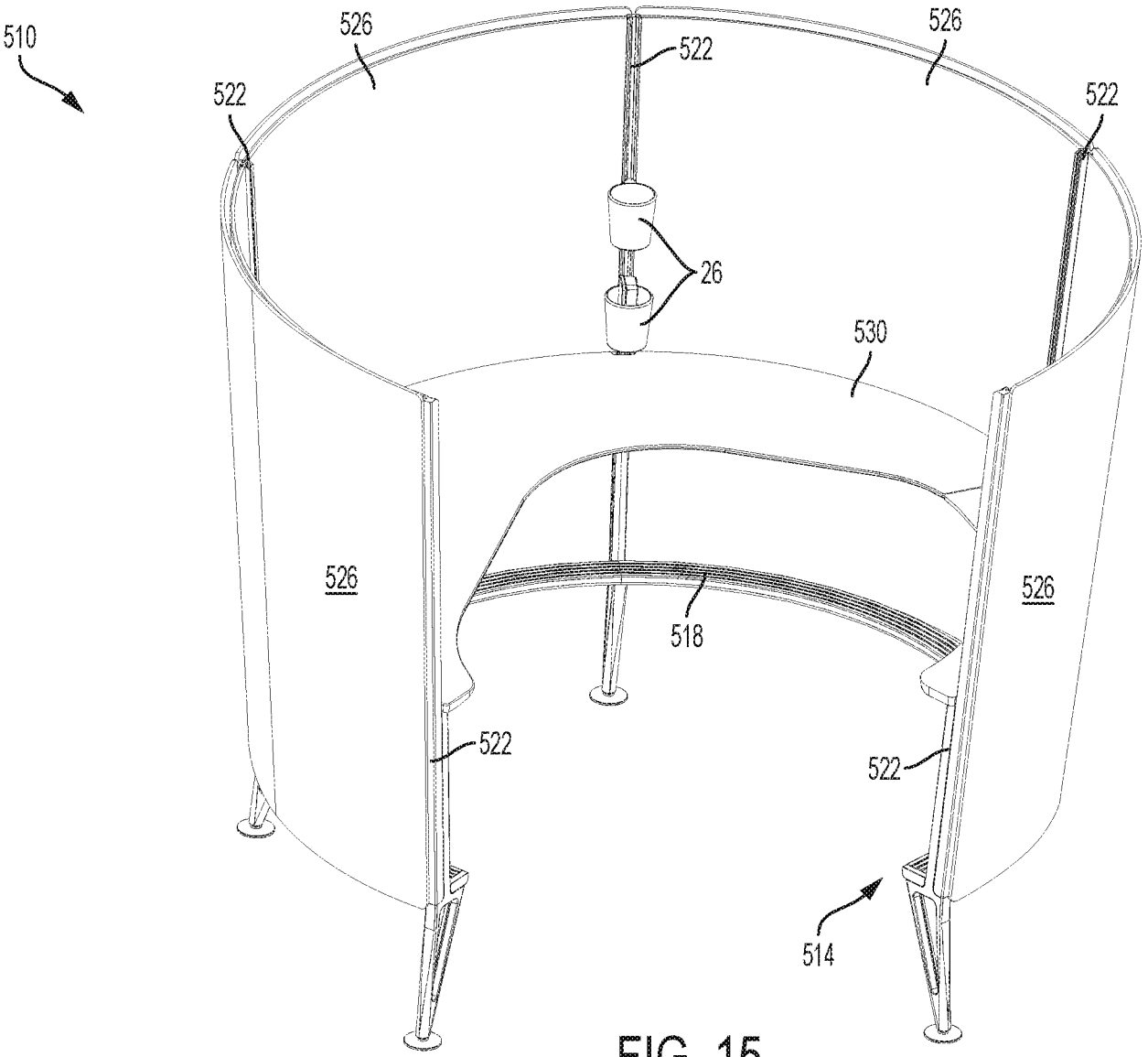
FIG. 15 is a perspective view of still another workstation embodying the invention.
Figure 16:
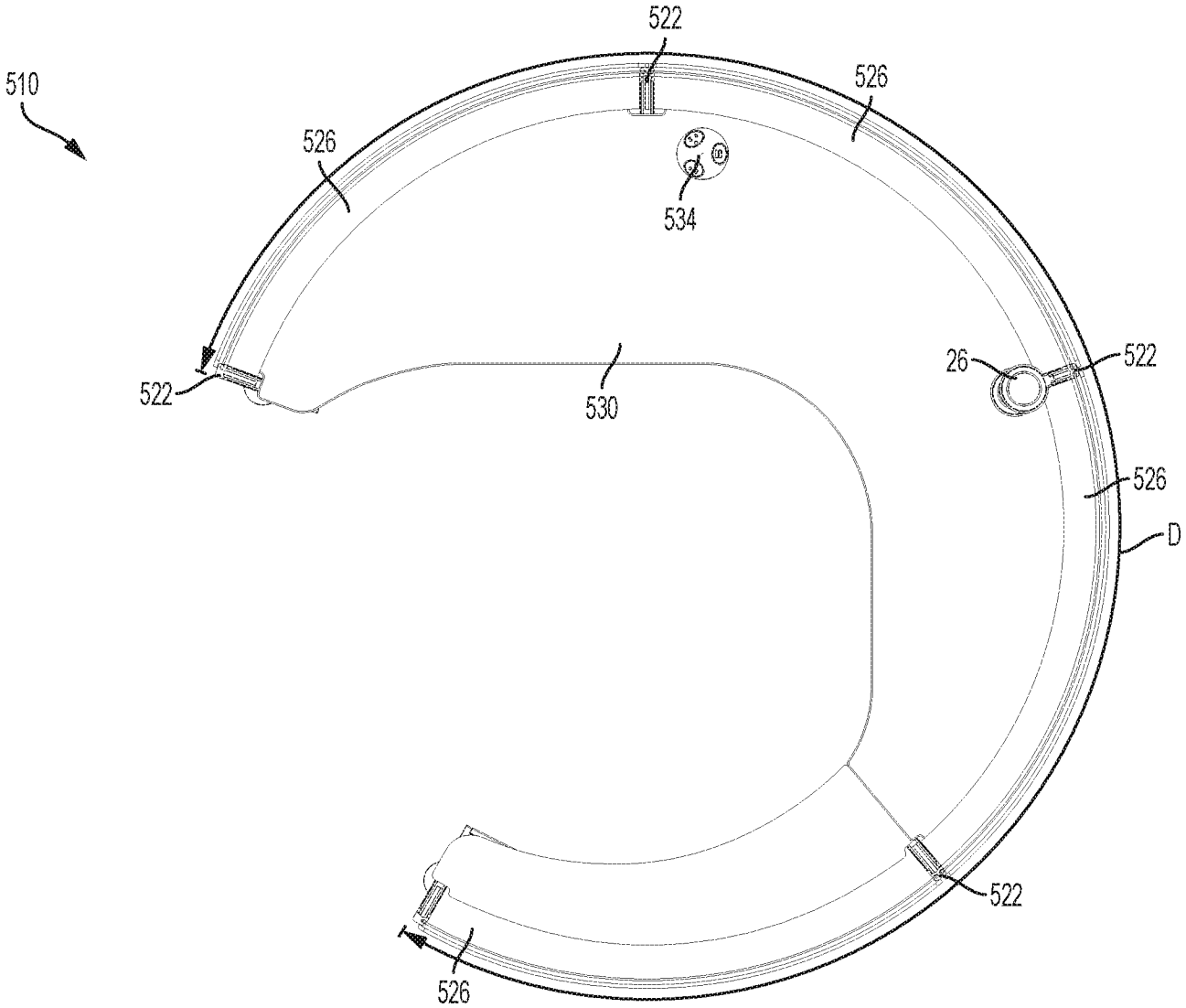
FIG. 16 is a top view of the workstation as shown in FIG. 15.

FIGS. 15 and 16 illustrate another workstation 510. Similar to the workstation 10 described above with reference to FIGS. 1-10, the illustrated workstation 510 includes a frame 514 having a lower rail 518 and a plurality of upright posts 522, and a plurality of panels 526. The frame 514 and the panels 526 are constructed in a manner similar to the frame 30 and the panels 34 discussed above. In the illustrated embodiment, however, the workstation 510 only, includes five upright posts 522 and four panels 526 so the workstation 510 extends through an arc D of less than 300 degrees. The illustrated arc D is about 280 degrees.

The illustrated workstation 510 also includes a table 530, or desk, supported by the upright posts 522 above the lower rail 518. The table 530 wraps around a user seated in a chair at the workstation 510. The table 530 also provides a worksurface for the user seated in the chair. In some embodiments, the table 530 may include additional accessories for the workstation, such as power outlets 534.

Figure 17:
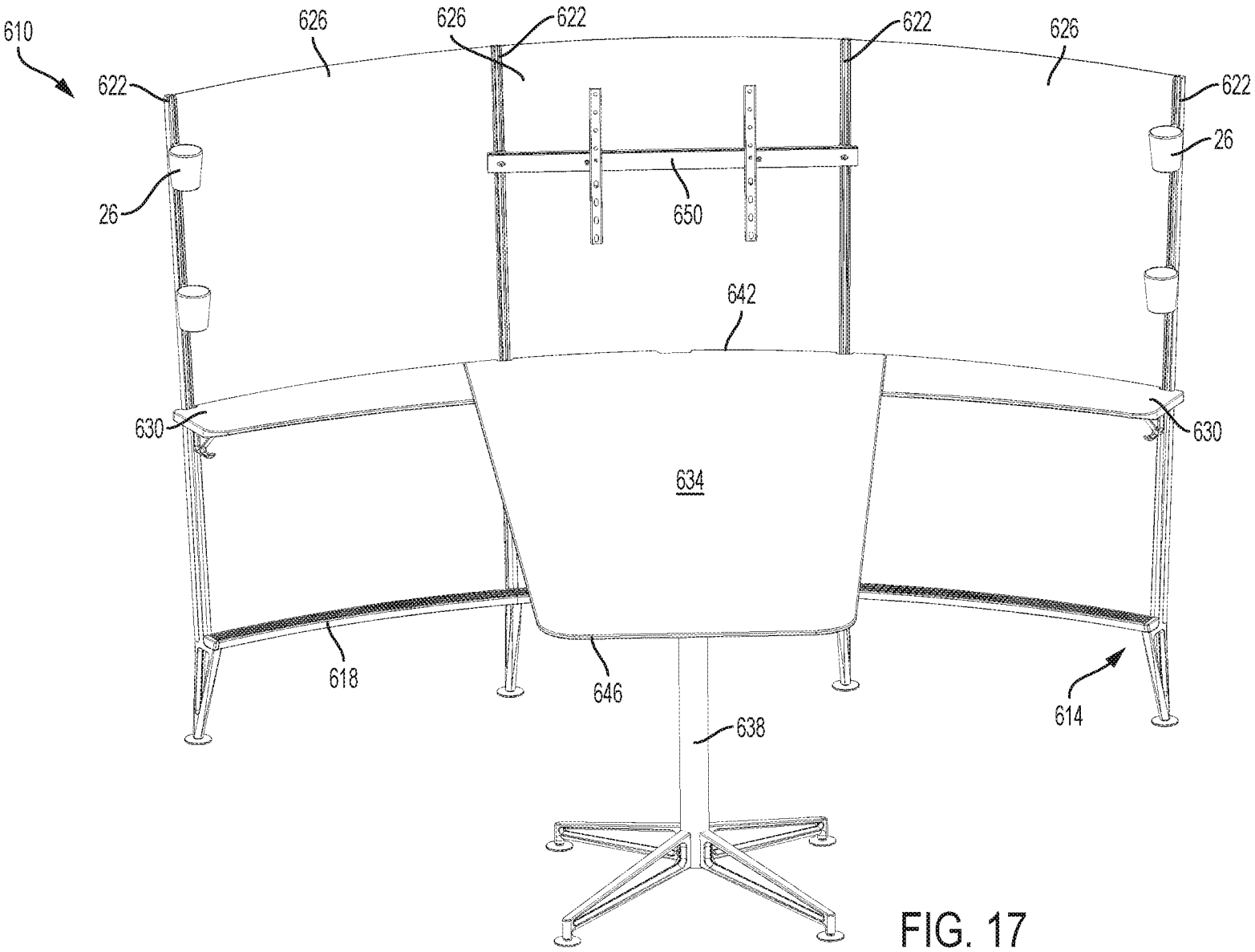
FIG. 17 is a perspective view of yet still another workstation embodying the invention.
Figure 18:
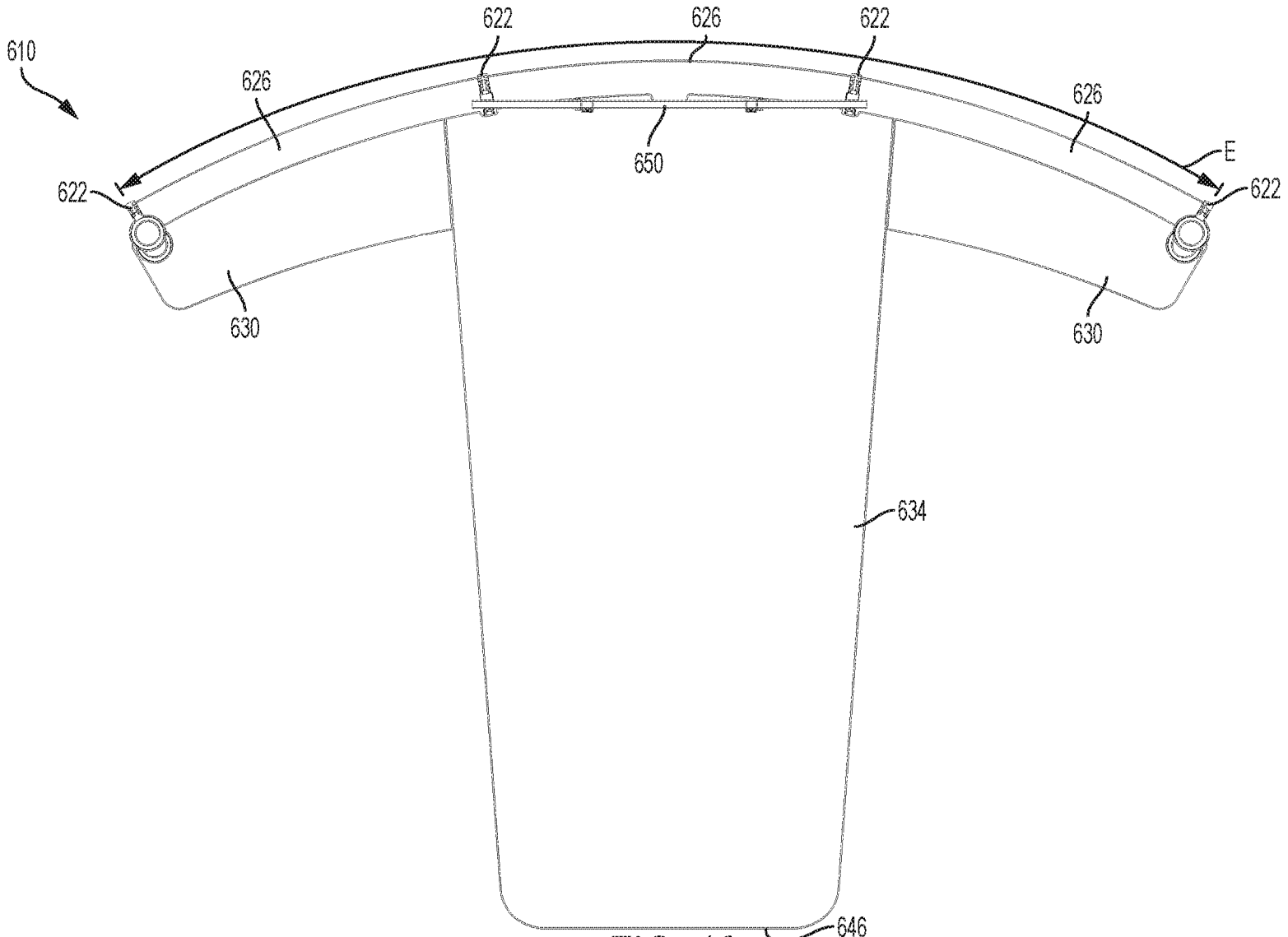
FIG. 18 is a top view of the workstation as shown in FIG. 17.

FIGS. 17 and 18 illustrate another workstation 610. Similar to the workstation 10 described above with reference to FIGS. 1-10, the illustrated workstation 610 includes a frame 614 having a lower rail 618 and a plurality of upright posts 622, and a plurality of panels 626. The frame 614 and the panels 626 are constructed in a manner similar to the frame 30 and the panels 34 discussed above. In the illustrated embodiment, however, the workstation 610 only includes four upright posts 622 and three panels 626 so the workstation 610 extends through an arc E of less than 90 degrees. The illustrated arc E is about 55 degrees.

The illustrated workstation 610 also includes shelves 630 and a table 634 supported by the upright posts 622 above the lower rail 618. The table 634 includes a leg 638, a first end 642 adjacent the panels 626, and a second end 646 opposite the first end 642. The table 634 extends outwardly from the panels 626 so that the second end 646 is near the origin of the arc E. The leg 638 is extends downwardly from the table 634 closer to the second end 646 than to the first end 642 to help support the table 634. The shelves 630 are supported by the upright posts 630 on either side of the table 634.

The illustrated workstation 610 further includes a mounting bracket 650 supported by the upright posts 622. In the illustrated embodiment, the mounting bracket 650 is supported by the two intermediate posts 622 of the workstation 610. The mounting bracket 650 is releasably, secured within channels of the upright posts 622 by, for example, threaded fasteners. The mounting bracket 650 is configured to support relatively heavy objects, such as a television or other screen for use with the workstation 610.

Figure 19:
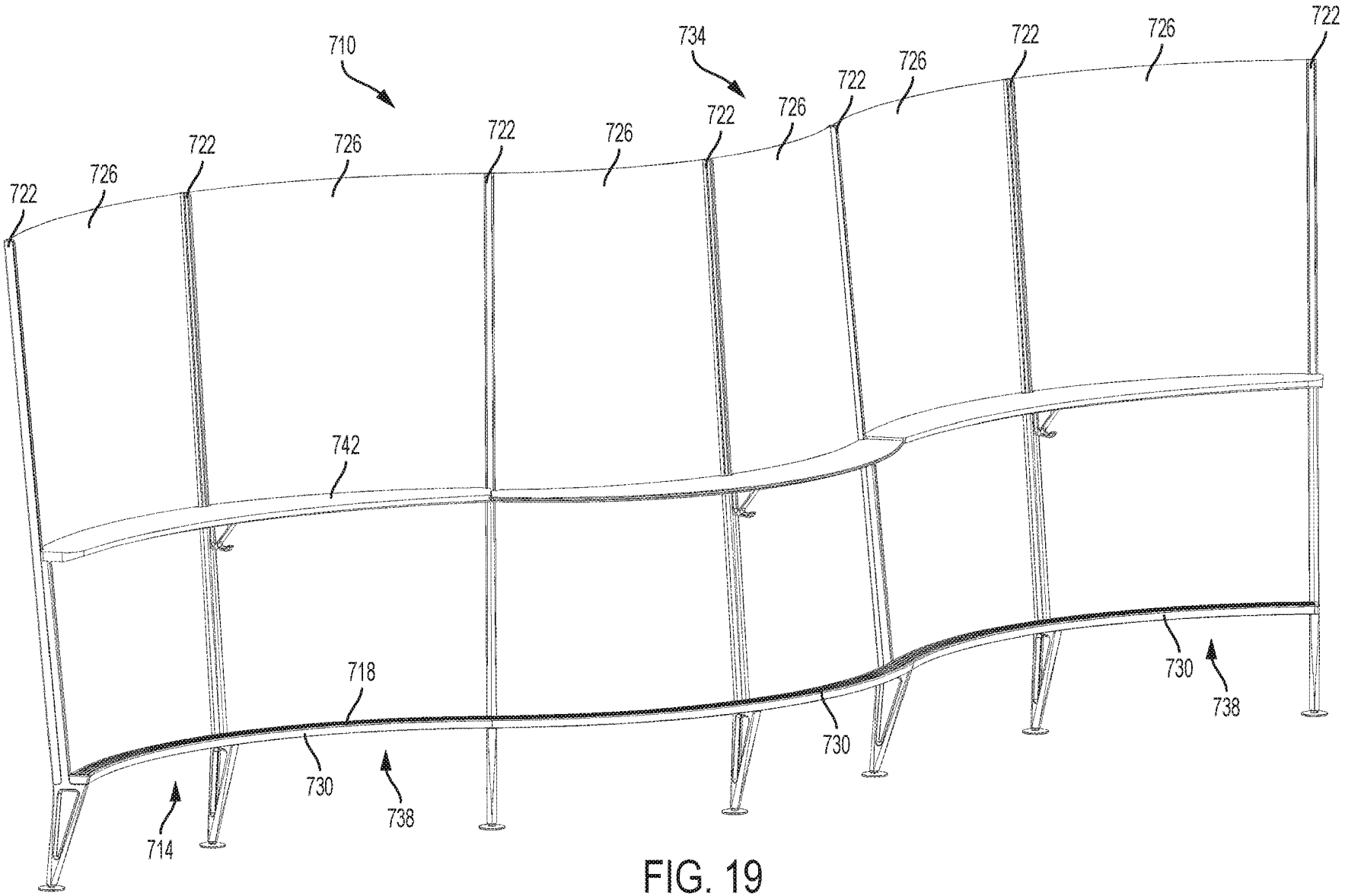
FIG. 19 is a perspective view of another workstation embodying the invention.
Figure 20:
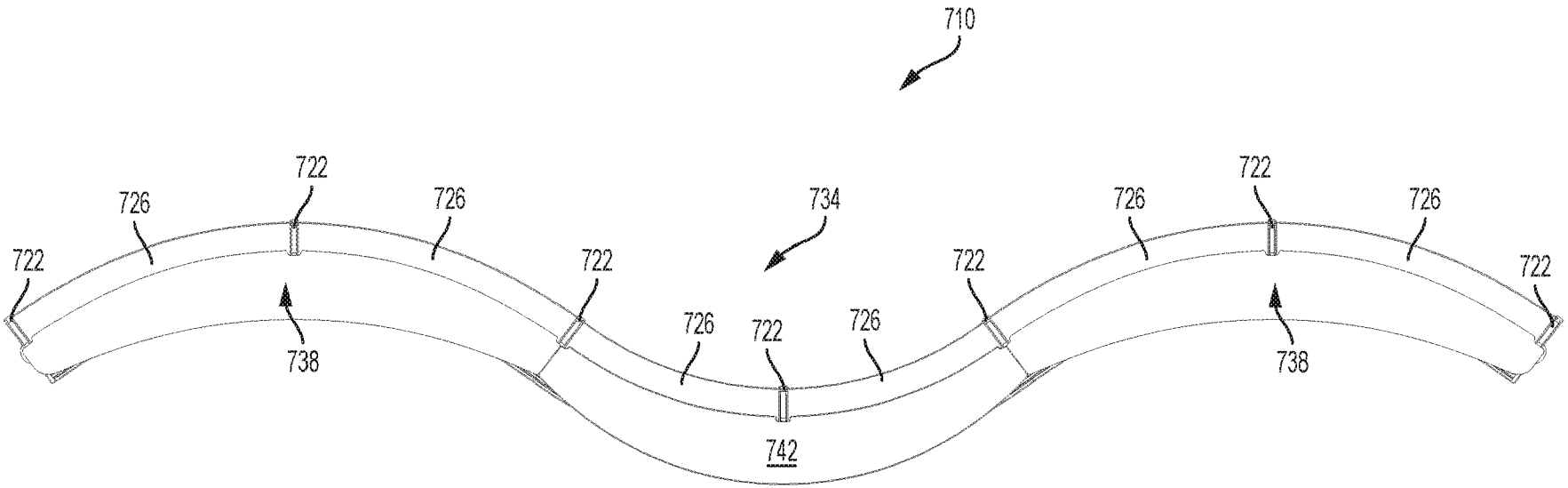
FIG. 20 is a top view of the workstation as shown in FIG. 19.

FIGS. 19 and 20 illustrate another workstation 710. In the illustrated embodiment, the workstation 710 is a screen designed to divide a work area from the rest of the room. Similar to the workstation 10 described above with reference to FIGS. 1-10, the illustrated workstation 710 includes a frame 714 having a lower rail 718 and a plurality of upright posts 722, and a plurality of panels 726. The frame 714 and the panels 726 are constructed in a manner similar to the frame 714 and the panels 726 discussed above. In the illustrated embodiment, the lower rail 718 includes a plurality of curved rail segments 730 coupled together to form a wave shape. As such, a middle section 734 of the workstation 710 is convex, while outer sections 738 of the workstation 710 are concave. In other embodiments, the workstation 710 may include fewer or more sections that are alternately concave and convex to provide a longer or shorter wave shape.

The illustrated workstation 710 also includes a shelf 742 supported by the upright posts 722 above the lower rail 718. The shelf 742 generally follows the wave shape of the lower rail 718. In other embodiments, the shelf 742 may be omitted, and/or other accessories or furniture items may be coupled to the upright posts 722.

Although the invention has been described in detail with reference to certain preferred embodiments, variations and modifications exist within the scope and spirit of one or more independent aspects of the invention as described. Various features and advantages of the invention are set forth in the following claims.

What is claimed is:

1. A workstation comprising:

a frame including a lower rail and a plurality of upright posts coupled to and extending upwardly from the lower rail, each upright post having a track; and a plurality of panels supported by the frame, each panel having a trapezoidal shape and including a first side edge received in the track of one of the plurality of upright posts, a second side edge received in the track of another of the plurality of upright posts, a lower edge adjacent the lower rail, the lower edge having a first length, and an upper edge opposite the lower edge, the upper edge having a second length that is generally parallel to the first length, the second length being longer than the first length.

2. The workstation of claim 1, wherein the first side edge and the second side edge of each of the plurality of panels extends from the upper edge to the lower edge.

3. The workstation of claim 2, wherein the first side edge and the second side edge of each of the plurality of panels extends linearly from the upper edge to the lower edge.

4. The workstation of claim 1, wherein on at least some of the plurality of upright posts, the track is formed on a first side of each upright post and a second track is formed on a second side of each upright post, and wherein the second track receives the first side edge or the second side edge of an adjacent panel.

5. The workstation of claim 1, wherein the lower rail has a curved shape that is fixed.

6. The workstation of claim 5, wherein each panel is bent between corresponding upright posts to match the curved shape of the lower rail.

7. The workstation of claim 1, further comprising a shelf positioned above the lower rail and coupled to the plurality of upright posts.

8. The workstation of claim 1, further comprising a table positioned above the lower rail and coupled to at least one of the plurality of upright posts.

9. The workstation of claim 8, wherein the table includes a leg, a first end adjacent the plurality of panels, and a second end opposite the first end, and wherein the leg of the table is closer to the second end than to the first end.

10. The workstation of claim 1, wherein each panel is composed of an aluminum composite material.

11. The workstation of claim 1, wherein each panel includes a first face and a second face, and wherein the first face includes a whiteboard surface.

12. The workstation of claim 11, wherein the first face and the second face are curved, and wherein the first face has a concave shape.

13. The workstation of claim 1, wherein the lower rail defines a lower arc radius of the workstation, wherein the upper edges of the plurality of panels define an upper arc radius of the panel, and wherein the upper arc radius is larger than the lower arc radius.

* * * * *